US005560419A

United States Patent [19]

Yoshida et al.

[11] Patent Number: 5,560,419

[45] Date of Patent: Oct. 1, 1996

[54] PRESSURE-CASTING METHOD AND APPARATUS

[75] Inventors: Atsushi Yoshida; Naomichi Yamamoto; Mitsuru Adachi; Thoru Tsuno; Kazuki Hiraizumi, all of Ube, Japan

[73] Assignee: Ube Industries, Ltd., Yamaguchi, Japan

[21] Appl. No.: 355,239

[22] Filed: Dec. 9, 1994

[30] Foreign Application Priority Data

Dec. 10, 1993 [JP] Japan ..... 5-310367

[51] Int. Cl.[6] ..... B22D 17/32; B22D 18/02; B22D 27/09

[52] U.S. Cl. ..... 164/4.1; 164/120; 164/154.8; 164/312; 164/319

[58] Field of Search ..... 164/4.1, 120, 154.8, 164/312, 319, 321, 155.3

[56] References Cited

U.S. PATENT DOCUMENTS

| | | | |
|---|---|---|---|
| 4,844,146 | 7/1989 | Kikuchi | 164/120 X |
| 4,884,621 | 12/1989 | Ban et al. | 164/4.1 |
| 4,932,458 | 6/1990 | Iwamoto et al. | 164/4.1 |
| 5,119,866 | 6/1992 | Mihara | 164/120 |
| 5,161,598 | 11/1992 | Iwamoto et al. | 164/4.1 X |

FOREIGN PATENT DOCUMENTS

| | | | |
|---|---|---|---|
| 1-197052 | 8/1989 | Japan | 164/120 |
| 2-207960 | 8/1990 | Japan . | |
| 3-124358 | 5/1991 | Japan . | |
| 3-71214 | 12/1991 | Japan . | |
| 5-104230 | 4/1993 | Japan | 164/120 |
| 5-104228 | 4/1993 | Japan | 164/120 |
| 5-138325 | 6/1993 | Japan | 164/120 |
| 6-190534 | 7/1994 | Japan . | |
| 6-226416 | 8/1994 | Japan | 164/120 |
| 6-226417 | 8/1994 | Japan | 164/120 |

OTHER PUBLICATIONS

Iten, Leo, et al. "Funktion und anwendungstechnischer Nutzen einer sekundäarstrom–und echtzeitgeregelten Druckgieszeinheit," Giesserei 79 (1992) Nr. 9–27 Apr., pp. 347–354 and English language abstract.

*Primary Examiner*—J. Reed Batten, Jr.
*Attorney, Agent, or Firm*—Finnegan, Henderson, Farabow, Garrett & Dunner, L.L.P.

[57] ABSTRACT

In a pressure-casting method and apparatus, wherein a metal melt is fed in a mold cavity and then an oscillating squeeze pressure is applied to the melt by a squeezing plunger of a hydraulic cylinder moving with an oscillating stroke varying to compensate for shrinkage of the melt while being solidified, the hydraulic cylinder is feedback-controlled, using a control unit including a detector for detecting information on an actual squeeze pressure, so that a pressure converted from the actual oscillating squeeze pressure to have a mean value of zero copies a desired alternately positive and negative impulsive pressure pattern or locus representing a pressure oscillated to have a mean value of zero with a given amplitude and frequency versus an elapse of time.

32 Claims, 15 Drawing Sheets

A
D
g
M
S5=S1-S2
S6= (S1-S2)/2
S4 = S3+S6
Xm
S1
S2
S3
S4
S5
S6
T
t 22 23 22

23

PRESSURE-CASTING METHOD AND APPARATUS

BACKGROUND OF THE INVENTION

1. Field of the Invention

The present invention relates to a pressure-casting method and apparatus for producing cast articles under a high pressure applied to a metal melt in a casting mold with a melt pressurizing plunger of a hydraulic cylinder exerting a stroke movement for compensating for shrinkage of the melt, particularly for producing cast articles of light metal alloy such as an aluminum alloy, magnesium alloy or the like.

2. Description of the Related Art

Such a pressure-casting method and apparatus are known, and are positively adopted for cast articles of light metal alloy requiring superior quantities regarding high strength and high pressure resistance, such as automotive vehicle parts. The melt pressure may be referred to as "a squeeze pressure", and the melt pressuring plunger may be called "a squeezing plunger". The squeezing plunger is a plunger different in some cases from the melt feeding or injecting plunger of a hydraulic cylinder, and in some other cases the injection plunger is used as the squeezing plunger after it has worked for feeding the melt.

With respect to the above pressure-casting method and apparatus, there is a known improved method or apparatus as disclosed in JP-A3-124358, wherein there is provided an oscillation transmitting rod other than the squeezing plunger that is disposed in a runner between a cavity and a gate in a casting mold to impart oscillation to the melt in the cavity through the gate by actuating the rod in a mechanical oscillation manner or a supersonic oscillation manner.

Further, JP-A3-71214 discloses another improved method or apparatus using an injection plunger as a squeezing plunger with a vibrator equipped to oscillate the melt.

Still further, there is a known improved method as disclosed in U.S. Pat. No. 5,119,866 corresponding to JP-A2-207960, wherein the melt in a mold cavity is pressurized with a squeezing plunger of a pressurizing hydraulic cylinder which is different from an injecting hydraulic cylinder by controlling the pressurizing hydraulic cylinder so that actual stroke movement of the squeezing plunger copies a desired curve or locus with respect to a desired oscillating stroke movement versus an elapse of time to thereby result in a melt in a mold cavity oscillating while the stroke compensates for the melt shrinkage.

JP-A3-7124, U.S. Pat. No. 5,119,866 and the present application are owned by the same applicant or assignee.

The above prior art methods or apparatus are advantages in improving a quality of cast articles, thanks to the oscillation of the melt. However, they are not yet satisfactory to obtain a target or desired quality, although hot tearing or cracking is reduced due to the melt shrinkage compensation under high squeezing pressure. In connection with this, the inventors have found that the cast articles produced by the prior art have in general a dominantly larger amount of columnar crystals generated with a lower amount of equiaxed crystals, and recognized for their various experiments that the equiaxed crystals contribute to a better quality of the cast articles regarding high strength and toughness behavior.

SUMMARY OF THE INVENTION

In this regard, an object of the present invention is to provide a method and apparatus for pressure-casting metal articles which have a refined metal structure with dominantly generated equiaxed crystals with no or a minimum amount of the columnar crystals, exhibiting a high quality superior to that of the cast articles produced by the conventional methods applying an oscillating pressure to the melt. Particularly, the object is to provide a pressure-casting and apparatus improved from the co-assignee's U.S. Pat. No. 5,199,866.

In comparison with the prior arts, particularly U.S. Pat. No. 5,119,866 the inventors have recognized that the prior arts are directed to a method of imparting oscillation to the melt by certain means, but is not directed to a method of controlling the melt oscillation per se as desired. Under the circumstances, the inventors made various experiments to investigate effects of melt oscillation for the quality of cast articles under various oscillation pressure conditions. With this recognition, the inventors have found that there may be a desired alternately positive and negative impulsive pressure pattern effective to ensure the melt to be equiaxe-crystalized substantially entirely if the high melt pressure is forced to oscillate in accordance with this impulsive pressure pattern while compensating for shrinkage of the melt.

As a result, the present invention has been completed as follows:

In accordance with one aspect of the present invention, there is provided a pressure-casting method comprising the steps of feeding a molten metal or melt to be casted into a cavity defined in a casting mold and applying an oscillating squeeze or holding pressure to the melt in the mold cavity by a squeezing plunger of a hydraulic cylinder being moved with a stroke oscillated to have a mean or maximum value varying to compensate for shrinkage of the melt while the melt is being solidified. This method concept per se is covered by U.S. Pat. No. 5,119,866.

The improvement of the present invention, however, resides in that the hydraulic cylinder with the squeezing plunger is controlled so that a pressure converted from an actual oscillating squeeze pressure applied to the melt to have a mean value of zero copies a predetermined alternately positive and negative impulsive pressure pattern or locus representing a pressure oscillated to have a mean value of zero with a predetermined amplitude and frequency versus an elapse of time. The frequency is defined as the number of oscillation cycles per second, and a predetermined amplitude is defined as the value which is a difference between a maximum value and a minimum value in an oscillation cycle or two times a difference between the maximum value and the zero mean value.

The hydraulic cylinder with the squeezing plunger may be feedback-controlled with the actual squeeze pressures and a predetermined squeeze pressure locus representing an oscillating squeeze pressure oscillated in accordance, with the predetermined impulsive pressure pattern versus an elapse of time, provided that the oscillating squeeze pressure has a mean value or a maximum value corresponding to a desired squeeze pressure exerted with the plunger stroke to compensate for the melt shrinkage while the melt is being solidified.

Alternatively, the hydraulic cylinder with the squeezing plunger may be feedback-controlled with the actual squeeze pressures, the predetermined impulsive pressure pattern and a predetermined plunger stroke locus representing a non-oscillating stroke varying to compensate for the melt shrinkage versus an elapse of time.

In the above alternative cases, the squeeze pressure applying step comprises sub-steps of applying a non-oscillating pressure increasing up to a predetermined value to the melt by increasing the plunger stroke and then carrying out the feedback-controlling for the oscillating squeeze pressure with the predetermined value as an initial mean or maximum value thereof.

Preferably, the oscillating squeeze pressure has the initial mean value of not less than 400 kg/cm$^2$ with an amplitude of 40 to 1000 kg/cm$^2$ or ±20 to 500 kg/cm$^2$ and a frequency of 5 to 200 Hz.

According to another aspect of the present invention, there is ]provided a pressure-casing apparatus for producing cast articles from a molten metal or melt, comprising: a casting mold having a hollow space to be filled with the melt including a cavity having a contour of the cast article a hydraulic cylinder having a squeezing plunger incorporated with the mold to expose a free end of the plunger to the melt filled in the hollow space; and a hydraulic pressure control unit for controlling the hydraulic cylinder to have the squeezing plunger effect a stroke movement exerting an oscillating squeeze pressure against the melt in the hollow space while compensating for shrinkage of the melt. The hydraulic pressure control unit may comprise:

1) valve means for changing a hydraulic pressure of the hydraulic cylinder in response to a valve drive signal to control actual stroke movement of the squeezing plunger;

2) valve drive means for generating the valve drive signal in response to a drive command signal;

3) means for .detecting actual squeeze pressures and generating actual pressure signals corresponding to the detected squeeze pressures at sampling time points with a given time interval between neighboring time points;

4) feedback control means including:

4-1) command signal setting means for presetting a desired pressure locus representing an oscillating squeeze pressure having a given mean or maximum value corresponding to a squeeze pressure exerted with a desired plunger stroke to compensate for the melt shrinkage with a predetermined pressure amplitude and frequency versus an elapse of time, and generating a reference pressure signal corresponding to a squeeze pressure derived from the preset pressure locus at each sampling time point; and 4-2) signal processing means comprising: means for detecting a deviation of the reference pressure signal from the actual pressure signal at each sampling time point to generate a pressure deviation signal; and gain setting means for converting the pressure deviation signal by applying a given control gain thereto into the drive command signal for the valve drive means.

The first given formula may be represented by an arithmetic mean of the pressure values measured during the longer given time interval up to the present sampling time point, and the second given formula is represented by an arithmetic mean of the stroke value measured during the longer given time interval up to the present sampling time point. The longer given time interval is equivalent to one or more cyclic periods of time.

Alternatively, the hydraulic pressure control unit may comprise:

1) valve means for changing a hydraulic pressure of the hydraulic cylinder in response to a valve drive signal to control actual stroke movement of the squeezing plunger;

2) valve drive means for generating the valve drive signal in response to a drive command signal;

3) means for detecting actual squeeze pressures and generating actual pressure signals corresponding to the detected squeeze pressures at sampling time points with a given shorter time interval between neighboring time points;

4) feedback control means including:

4)-1 first command signal setting means for presetting an alternately positively and negatively impulsive pressure pattern as desired and generating a reference impulsive pressure signal corresponding to a squeeze pressure derived from the preset impulsive pressure pattern at each sampling time point;

4-2) second command signal setting means for presetting a desired plunger stroke locus representing a non-oscillating stroke varying to compensate for the melt shrinkage versus an elapse of time and generating a reference stroke signal corresponding to a stroke derived from the preset stroke locus at each sampling time point;

4-3) first signal processing means comprising: a first calculator for generating a differential signal corresponding to a difference between the actual oscillating squeeze pressure at the sampling time point and an assumed mean value thereof, which is calculated with the actual pressure signals generated during a given longer time interval up to the present sampling time point in accordance with a first given formula; first means for detecting a first deviation of the reference impulsive pressure signal at the present sampling time point from the differential signal generated by the first calculator to generate an impulsive pressure deviation signal; and first gain setting means for converting the impulsive pressure deviation signal by applying a first given gain thereto into a first drive command signal element;

4-4) second signal processing means comprising: a second calculator for generating a mean value signal corresponding to an assumed mean value of the actual oscillating stroke at the present sampling time point, which is calculated with the actual stroke signals generated during the given longer time interval up to the present sampling time point in accordance with a second given formula; second means for detecting a second deviation of the reference stroke signal at the present sampling time point from the mean value signal generated by the second calculator to generate a stroke deviation signal; and second gain setting means for converting the stroke deviation signal by applying a second given gain thereto into a second drive command signal element; and 4-5) a gain adder for generating the drive command signal for the valve drive means by adding the first drive command signal element to the second signal element.

The first given formula may be represented by an arithmetic mean of the pressure values measured during the longer given time interval up to the present sampling time point, and the second given formula is represented by a sum of an arithmetic mean of the stroke values measured during the longer given time interval up to the present sampling time point and a half of a difference between the two stroke values measured at the present sampling time point and a past sampling time point prior to the present sampling time point by the longer given time interval. The longer given time interval is equivalent to one or more cyclic periods of time.

Preferably, the preset oscillating pressure locus may be determined to have a desired maximum pressure value to compensate for the melt shrinkage in a first case where an injection plunger of an injecting hydraulic cylinder for feeding the melt in the mold cavity is controlled to exert a predetermined pressure against the melt after the injection is completed, whereas the pressure locus may be determined to have a desired mean pressure value to compensate for the melt shrinkage in a second case where the injection plunger is stopped by means of a stopper after the injection is completed. Similarly, preferably, the preset non-oscillating stroke locus may be determined to have a stroke value decreased from the value desired to compensate for the melt shrinkage to such a extent that the resultant actual stroke is oscillated to have a desired maximum value to compensate for the melt shrinkage in the above first case, whereas the preset non-oscillating locus may be determined to have a desired stroke value desired to compensate for the melt shrinkage with the result that the actual stroke is oscillated to have a desired mean value to compensate for the melt shrinkage in the above second case.

According to the present invention, the melt in the mold cavity is subjected additionally to an alternately positive and negative impulsive pressure as desired, while the melt is subjected to a high squeeze pressure for compensating for the melt shrinkage. As a result, a heat transfer coefficient at an interface between the cavity surface and the melt surface is cyclically changed and an amount of heat escaping from the melt into the mold is cyclically varied accordingly. Due to the cyclically changing heat transfer coefficient, latent heat generated when the melt is solidified locally is not allowed to escape from the melt into the mold at the cavity surface, with the result that the melt temperature is elevated locally in the melt. This-phenomenon may be called a "recalescence" phenomenon, and due to this phenomenon separation of the generated crystals and melt-down separation of branched columnar crystals occur progressively.

Under the circumstances, solidification of the melt is developed such that the melt is nucleated not only at the melt surface but also throughout the melt to generate equiaxed crystals dominantly in the entire melt, and thus the melt becomes in a so called "Mushy state" of solidification. Therefore, according to the present invention using an alternately positive and negative impulsive pressure desired to a melt material and a mold cavity geometry with a desired squeeze high pressure to compensate for the melt shrinkage, there is obtained a cast article having high strength and toughness with no substantial heat tearing and shrinkage generated.

In marked contrast, when the melt is subjected to a constant high pressure for compensating for the melt shrinkage, a dominant amount of columnar crystals are generated along the Cavity surface with equiaxed crystals surrounded by the columnar crystal in a central region of the melt and with banding segregation generated.

Further, in a case where the method of U.S. Pat. No. 5,119,866 of controlling a stroke movement of the squeezing plunger is carried out to thereby have the stroke oscillated to have a desired mean or maximum value to compensate for the melt shrinkage with the result that an actual squeeze pressure is oscillated, there may be two alternative results.

In a case where the resultant squeeze pressure is oscillated at an initial stage of the melt solidification to have a similar amplitude to that of the present invention, which is suitable to improve the melt structure as stated above, the pressure amplitude is forced to increase while the melt is being solidified. As a result, thermal tearing or cracking occurs in the solidified melt.

In another case where the resultant squeeze pressure is oscillated at a final stage of the melt solidification to have a similar amplitude to that of the present invention, which is suitable-to prevent occurrence of hot tearing, the pressure amplitude, in turn, is forced to decrease to a low value at an initial stage of the melt solidification, insufficient to effect the melt-down and separation of the generated crystals leading to dominantly generated equiaxed crystals as stated above. As a result, the quality would not be improved, although hot tearing does not occur in the solidified melt.

BRIEF DESCRIPTION OF THE DRAWINGS

The above and other objects, features, and advantages of the present invention will be made more apparent from the description of preferred embodiments with reference to the accompanying drawings wherein.

DESCRIPTION OF THE PREFERRED EMBODIMENTS

It should be understood that, throughout the drawings of the embodiments of the present invention, like or the same elements and parts are designated by the same reference minerals and the same references.

Figures 1, 3:
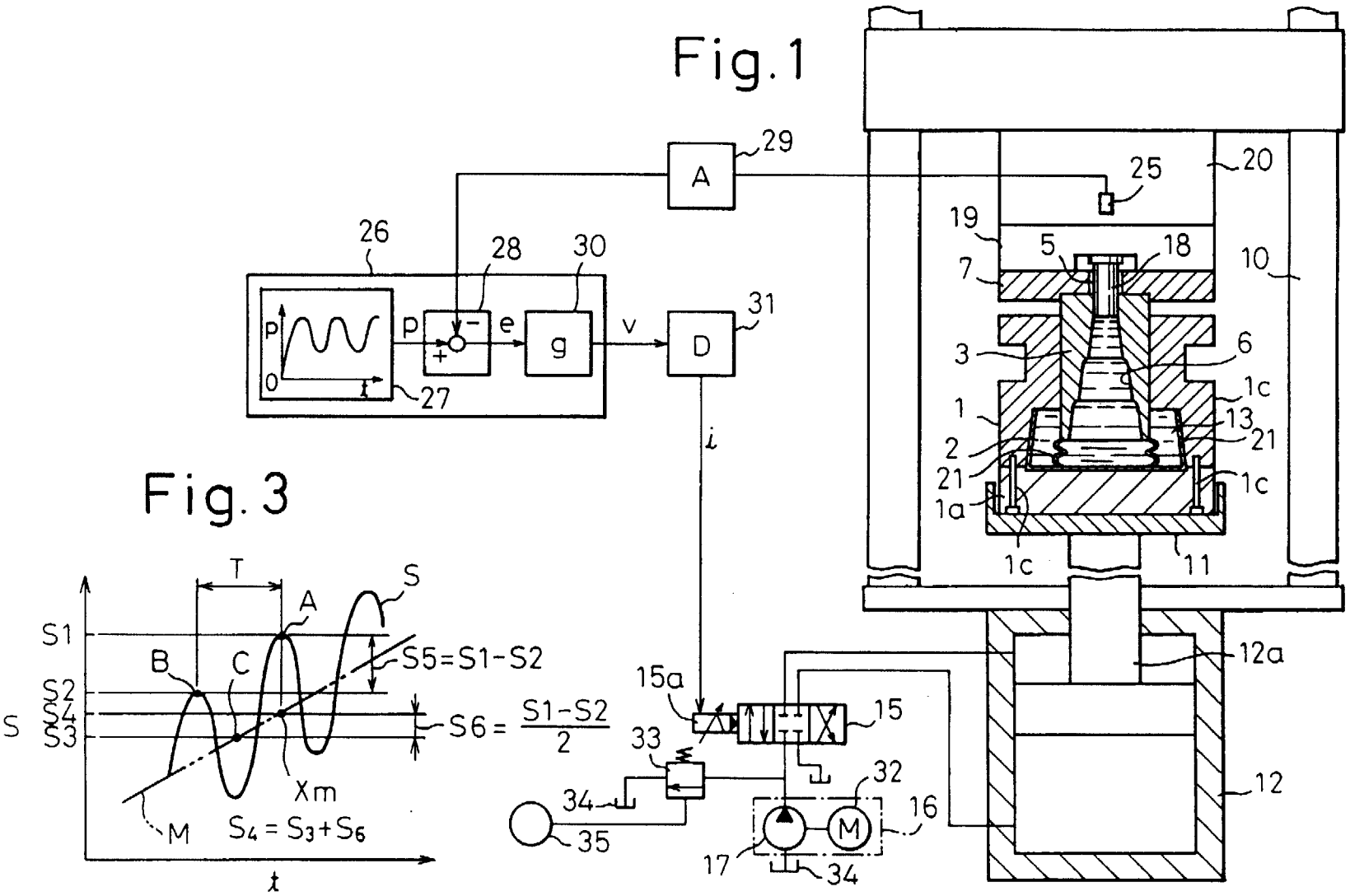
FIG. 1 is a block diagram of a system for controlling the operation of a pressure-casting apparatus according to an embodiment of the present invention.
FIG. 3 is a graph illustrating a relationship between an oscillating stroke of a squeezing plunger versus an elapse of time in order to explain a method of formulating a formula to be applied to calculate an assumed mean value of the oscillating stroke.

Referring to FIG. 1, a pressure-casting apparatus according to the present invention comprises: a mold composed of a female mold half 1 and a male mold half 3; a squeezing hydraulic cylinder or actuator 12 with a squeezing plunger 12*a;* a solenoid-operated directional control valve 15; a relief value 33 for load and unload, operated in response to a command signal from a load command unit 35; a hydraulic power source 16 including an oil tank 34; a motor 35; and a feedback control unit.

In the embodied apparatus, there is no injecting hydraulic cylinder with an injection plunger provided, but a melt pouring device, instead, is provided (not shown). The, apparatus has a tie bar arrangement 10 with a weight plate 20 mounted slidably along tie bars, and also has a stationary base plate 7 having a central hole 5 with the male mold half 3 detachably fixed to communicate therewith. The female mold half 1 is composed of a bottom part of a plate form 1*a* and a top cylindrical part 1*c* forming a larger stepped cavity element 2, while the male mold half 3 is of a cylindrical form defining a smaller stepped cavity element 4. Both mold halves 1, 3 are combined to have a mold cavity defined by the larger and smaller stepped cavity elements 2, 6.

The apparatus further comprises a closure plate 19 equipped with an ejector pin 18. The closure plate 19 is detachably mounted on the stationary base plate 7 with the ejector pin 18 being disposed through the hole 5 into the small cavity element 6 of the male mold half 3, after a melt 13 is poured into the mold cavity through the hole 5 by means of the melt feeding device, while the weight plate 20 is vertically spaced from the stationary base plate 7. After the closure plate 19 is mounted on the stationary base plate 7, the weight plate 20 descends to rest on the closure plate 19.

The bottom part 1*a* of the female mold half 1 is detachably connected to the top part 1*c* by means of bolts 1*b*, and is mounted on a support plate 11 which is connected to the squeezing plunger 12*a* at the top end thereof. When the hydraulic cylinder 12 is operated with the squeezing plunger 12*a*, the mold cavity is changed in volume in cooperation of the female mold half 1 and the male mold half 3 slidably disposed therein.

The female and male mold halves 1, 3 have ceramic papers attached to the cavity surfaces as thermal insulators provided in each casting cycle to prevent the melt from being rapidly cooled at the cavity walls so that casting at the initial stage can be effected without immediately generating a solid phase of the melt at the cavity surface.

In this embodiment, the mold composed of the male and female mold halves 1, 3 is designed to have an outlet for allowing a cast article to be removed from the entire cavity in the axial direction and to have the squeeze pressure applied to the melt axially. The entire mold cavity defined by the larger and smaller cavities elements 2, 6 is contoured to allow the cast article to be removed axially. The outlet for the cast article is open when the bottom part 1*a* of the female mold half 1 is removed, after the plunger 12*a* is retracted.

When the melt is poured into the entire cavity of the mold through the hole 5, the ejector pin 18 is inserted in the hole 5 to close the mold, and then the actuator 12 is activated to effect an oscillating stroke movement of the squeezing plunger 12*a*, so that a squeeze pressure applied to the melt is oscillated to have a maximum value of, for example, 600 $kg/cm^2$ and a minimum value of, for example, 60 $kg/cm^2$ with a frequency of, for example, 10 Hz or 100 Hz.

The maximum value of the squeeze pressure may be not less than 250 $kg/cm^2$ as needed, while in an extreme case the minimum value is allowed to be 0 $kg/cm^2$ or a value relatively close to the maximum value. The frequency may be in the range of 0.5 to 100 Hz. If the frequency is too high, the apparatus may be broken, and thus the frequency should be at the highest 1000 Hz, while a preferable frequency is 10 to 100 Hz.

Figure 8:
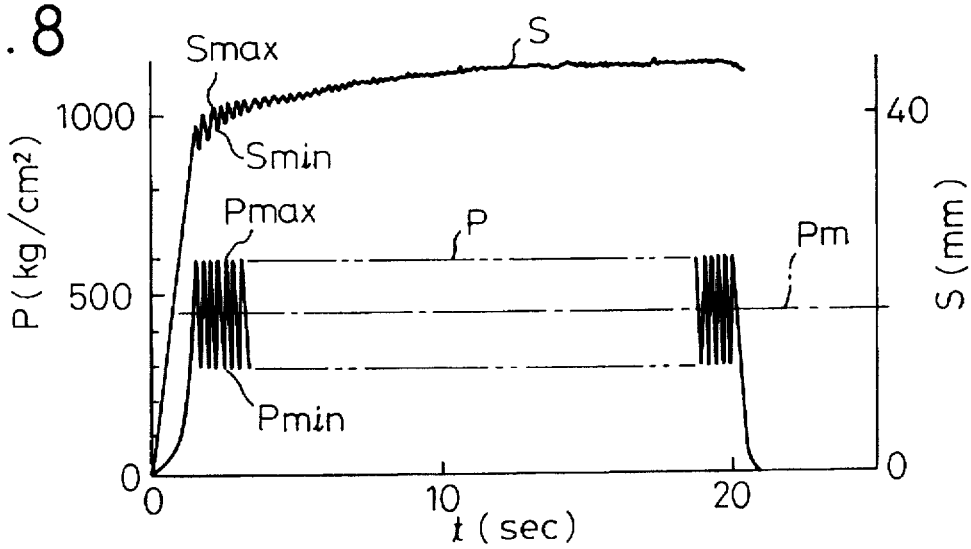
FIG. 8 is an illustrative graph indicating an actual oscillating stroke and an actual oscillating pressure in comparison versus an elapse of time, generated according to an embodiment of the present invention.

FIG. 8 shows a curve representing an actual oscillating squeeze pressure versus an elapse of time in a case where with the apparatus as shown in FIG. 1 the melt 13 of aluminium alloy, AC4CH, was poured into the cavities 2, 6 of the female and male mold halves 1, 3 at a melt temperature of 760° C., and the actuator 12 was controlled so that a squeeze pressure to be applied to the melt is oscillated to have a mean value of 450 $kg/cm^2$ with an amplitude of 300 $kg/cm^2$ or ±150 $kg/cm^2$ (that is, a maximum value of 600 $kg/cm^2$ and a minimum value of 300 $kg/cm^2$) and a frequency of 20 Hz. FIG. 8 also shows another curve representing an actual oscillating stroke of the squeeze plunger 12*a* versus an elapse of time for reference. The maximum values of the oscillating squeeze pressure and stroke are desired values to compensate for the melt shrinkage.

In FIG. 8, the starting time point of the two curves corresponds to the time that the female mold half 1 commences to elevate. After a predetermined period of time, for example, 20 seconds, elapses from the starting time point, the actuator operation for applying the squeeze pressure to the melt is stopped, and then the female mold half 1 is forced to descend to open the mold, while the push pin 18 is further ejected to push a cast article in the mold. The cast article is removed from the mold after the bolts 1*b* are disengaged and the bottom part 1*a* of the female mold half 1 is removed away.

Figure 15:
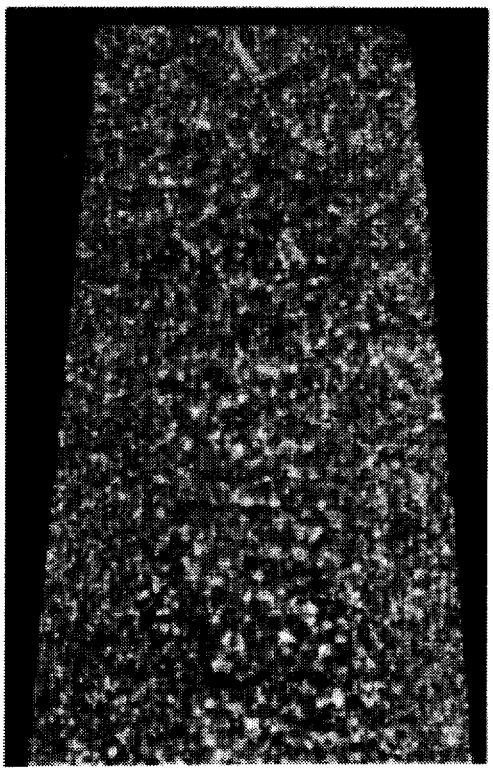
FIG. 15 is a photograph showing a refined metal structure of a cast test piece of AC4CH alloy, produced under the oscillating pressure according to the present invention as a result of the crystallizing process as shown in FIGS. 13A to 13C.

The cast article was cut to form a test piece, and a picture of the test piece was taken to show a metal structure of the cast article produced in accordance with the present invention. FIG. 15 shows the metal structure using the taken picture. As being apparent from FIG. 15, such a cast product according to the present invention has equiaxed crystals 23 distributed throughout the sectional surface, that is, entirely.

Figure 13A:
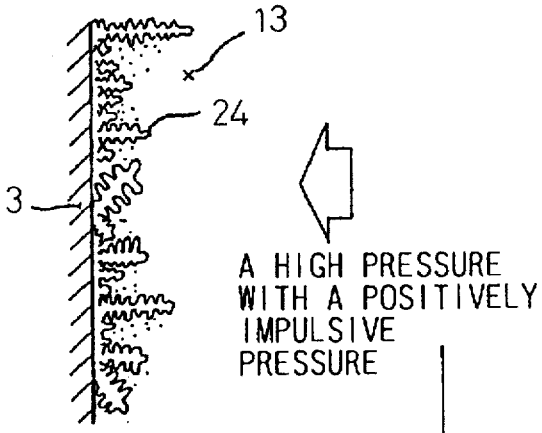
FIGS. 13A to FIGS. 13C are views illustrating generation of crystals under a high pressure, oscillating in accordance with an alternately positive and negative impulsive pressure pattern as desired according to the present invention, applied while the melt is being solidified, at three sequential time points, respectively, particularly showing generation of an increased amount of equiaxed crystals, while the once generated columnar crystals are broken away.
Figure 13B:
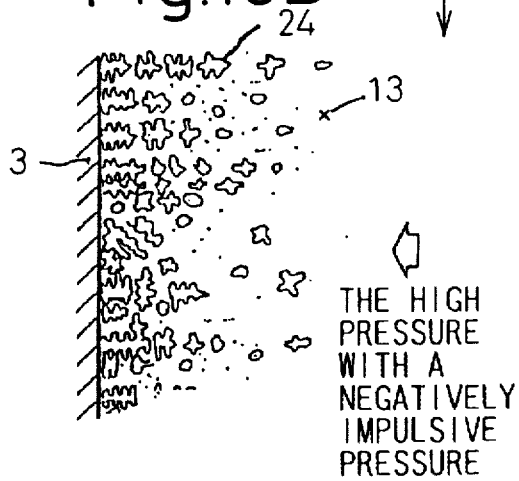
Figure 13C:
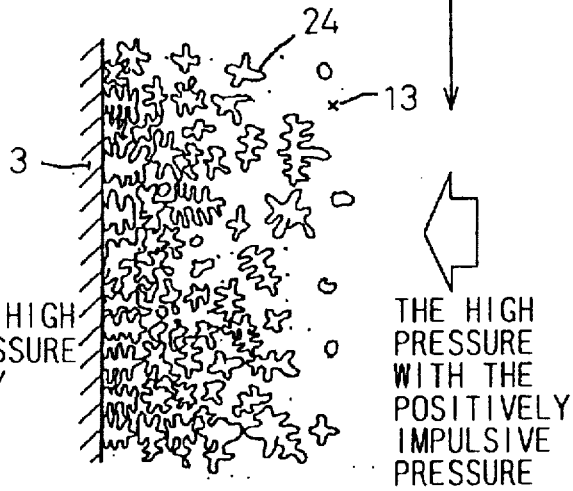

FIGS. 13A to 13C illustrate in an enlarged manner a metal structure of the cast article at a region near the cavity surface of the mold half 3 changing while time elapses or the melt is being solidified.

Referring to FIG. 13A, when the melt 13 is pressed firmly against the surface of the cavity 6 at the initial maximum value of the oscillating squeeze pressure, generation of crystal 24 commences. That is, while the melt subjected to a high pressure equivalent to the mean value (450 kg/cm$^2$) of the oscillating squeeze pressure, it is subjected to a positively impulsive pressure of +150 kg/cm$^2$, and crystals 24 commence being generated at the cavity surface, as illustrated in FIG. 13A.

At a subsequent minimum value of the oscillating squeeze pressure, a force pushing the melt 13 against the cavity surface is reduced accordingly, that is, while the melt is subjected to the high pressure of 450 kg/cm$^2$, it is further subjected to a negatively impulsive pressure of −150 kg/cm$^2$ and therefore an amount of heat transmitted from the melt 13 to the mold half 3 is reduced with the result that melting-down into pieces and separation of the generated crystals occur as illustrated in FIG. 13B.

In this connection, at a subsequent maximum value of the oscillating squeeze pressure, the crystals 24 are kept as those in the melt-down and separated manner as illustrated in FIG. 13C with the result that solidification of the melt with the crystal pieces working as nuclei develops. In this connection, no columnar crystals are generated or grown, thanks to the maximum and minimum values of the oscillating squeeze pressure being repeated in a short period of time, that is, thanks to the melt subjected to the high pressure of 450 kg/cm$^2$ being subjected to an alternately positive and negative impulsive pressure (i.e., ±150 kg/cm$^2$), with the result that the equiaxed crystals are generated dominantly over the entire sectional surface of the cast article. The dominantly generated equiaxed crystals prevent segregation and hot tearing from occurring, and cause refined grains to be produced to thereby improve the strength of the cast article.

Figure 6:
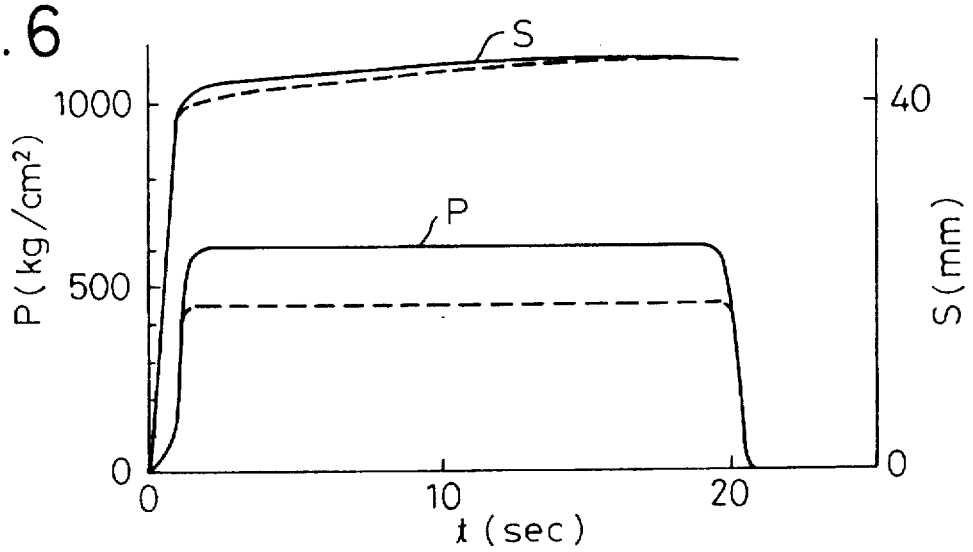
FIG. 6 is an illustrative graph indicating an actual non-oscillating stroke and an actual non-oscillating pressure in comparison versus an elapse of time, generated according to a prior art.
Figure 12A:
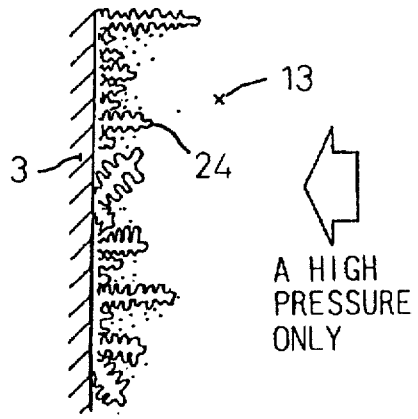
FIGS. 12A to 12C are views illustrating generation of crystals in the melt at a region near the cavity surface under a non-oscillating high pressure applied while the melt is being solidified at three sequential time points, respectively, particularly showing growing of columnar crystals.
Figure 12B:
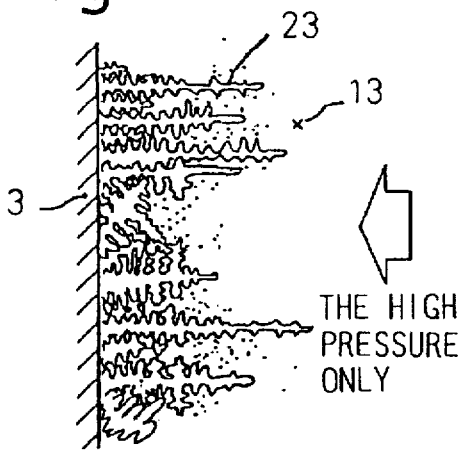
Figure 12C:
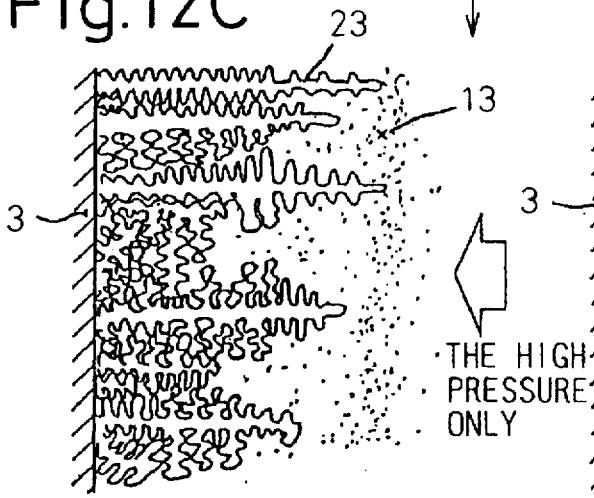
Figure 14:
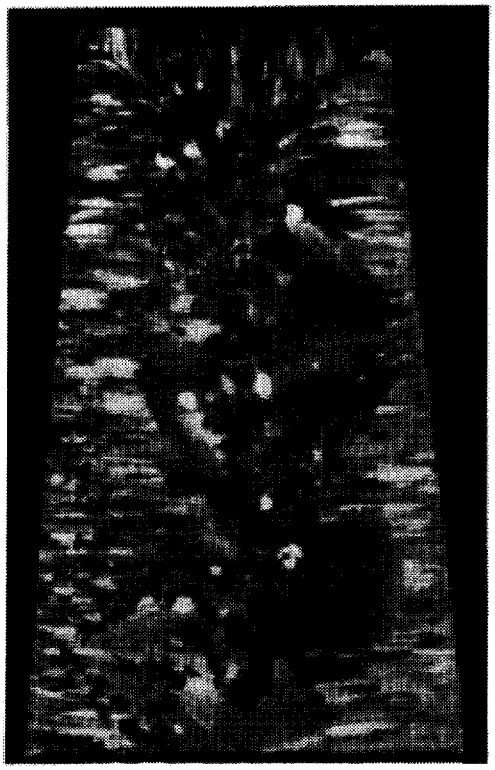
FIG. 14 is a photograph showing a coarse metal structure of a cast test piece of AC4CH alloy, produced under the non-oscillating pressure as a result of the crystallizing process as shown in FIGS. 12A to FIG. 12C.

In comparison,, a non-oscillating squeeze pressure as indicated in FIG. 6 by a solid line was applied for 20 seconds to a melt of AC4CH at a melt temperature of 760° C. in the apparatus as shown in FIG. 1 to produce a comparative cast article. The non-oscillating squeeze pressure is 600 kg/cm$^2$ with a desired non-oscillating stroke varying to compensate for the melt shrinkage as shown in FIG. 6 according to the original pressure-casting method. The solid lines in FIG. 6 represent desired values of the non-oscillating squeeze pressure and stroke to compensate for the melt shrinkage, respectively, while dotted lines in FIG. 6 represent values corresponding to the mean values of the oscillating squeeze pressure and stroke in FIG. 8. The comparative cast article was cut into a test piece. A picture of the comparative test piece is shown in FIG. 14. As being apparent from FIG. 14, such a cast article as the comparative one has dominantly generated columnar crystals. The generation of the columnar crystals in the comparative test piece is illustrated in FIGS. 12A to 12C corresponding to FIGS. 13A to 13C. Since a constant high pressure is applied in the squeezing pressure process, no melting-down and separation of the generated columnar crystals occur while segregation occurs.

Figure 7:
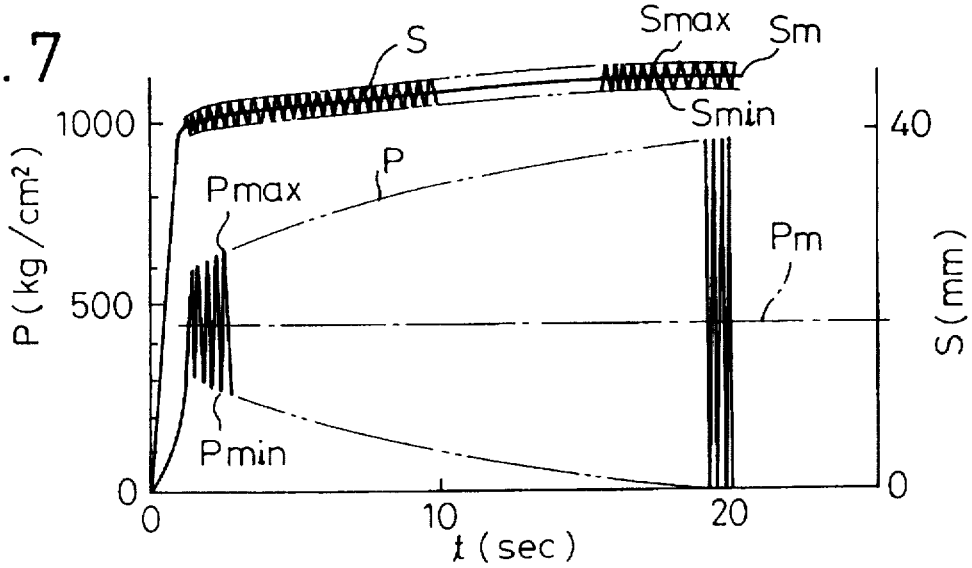
FIG. 7 is an illustrative graph indicating an actual oscillating stroke and an actual oscillating pressure in comparison versus an elapse of time, generated according to another prior art.

In further comparison, the pressure-casting method as disclosed in U.S. Pat. No. 5,119,866 was carried out with a melt of AC4CH using the apparatus as shown in FIG. 1 at an initial melt temperature of 740° C. and thus the actuator 12 was controlled for 20 seconds so that an actual stroke of the plunger 12*a* is oscillated to have the same mean value as that of the inventive case (FIG. 8) with the same amplitude as that of the inventive case at the initial oscillation stage with the same frequency of 20 Hz as that of the inventive case, as indicated in FIG. 7. As a result, an actual squeeze pressure applied to the melt was oscillated to have the same mean value of 450 kg/cm$^2$ as that of the inventive case with the same frequency of 20 Hz, but with an amplitude which is a function of time and increases from the same value of 300 kg/cm$^2$ as that of the inventive case to about 900 kg/cm$^2$ or about 450 kg/cm$^2$, as shown in FIG. 7.

Such an increasing pressure amplitude as above leads to occurrence of undesired hot tearing in the cast article. If the actual squeeze pressure in turn were oscillated to have an amplitude of 300 kg/cm$^2$ at a final stage of the melt solidification, it would be forced to have a considerably lower value of the pressure amplitude which does not cause the melt to be nucleated to an enough extent to generate equiaxed crystals dominantly in the cast article.

Figure 4:
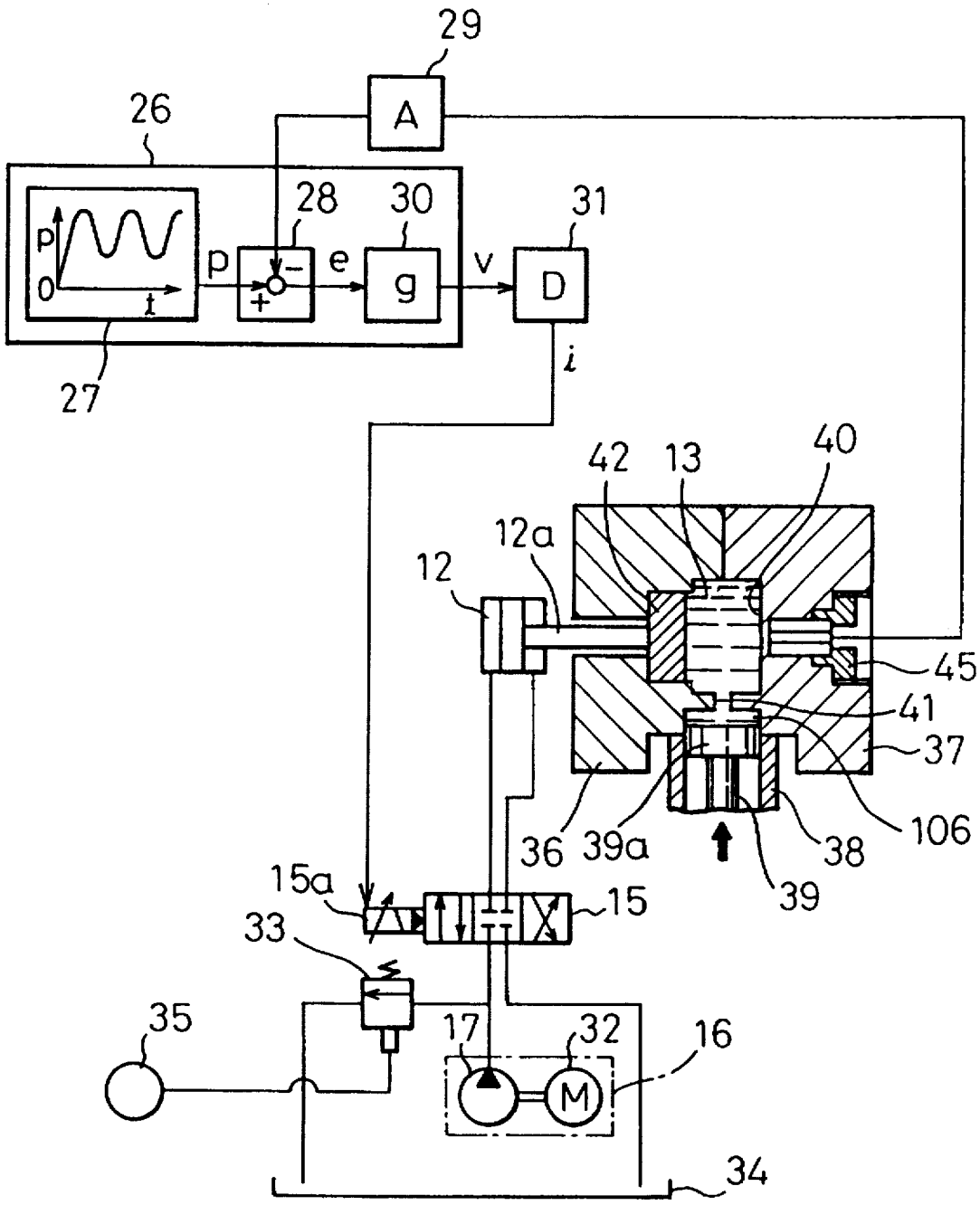
FIG. 4 is a block diagram of a system similar to that of FIG. 1 for controlling the operation of pressure-casting apparatus similar to that of FIG. 2.
Figure 5:
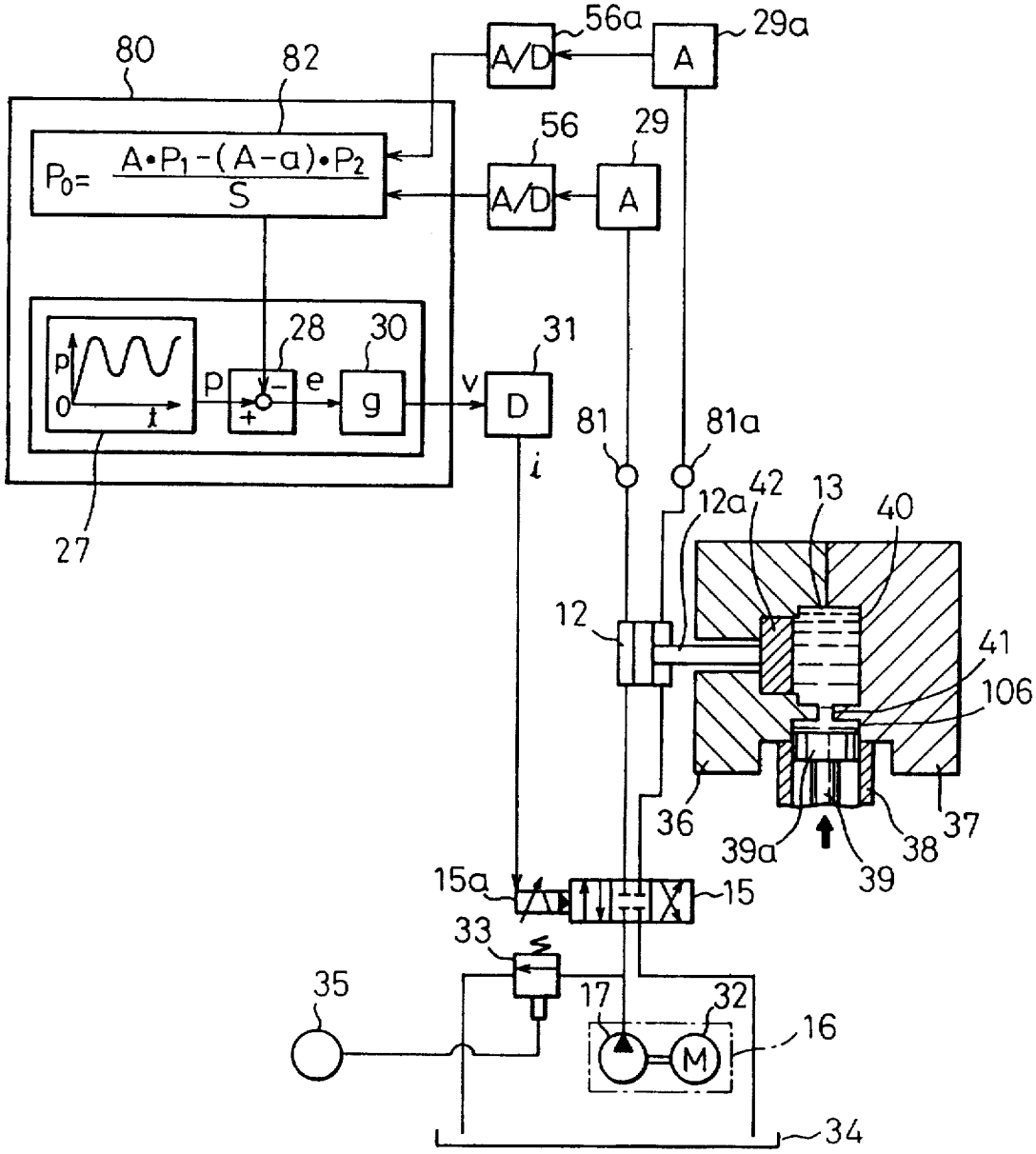
FIG. 5 is a block diagram of a system modified from that of FIG. 4 for controlling the operation of a pressure-casting apparatus modified from that of FIG. 4.

According to the present invention, the squeeze pressure is obtained by feedback-controlling the squeezing hydraulic cylinder using a control unit. According to one method, the hydraulic cylinder is feedback-controlled using a predetermined or preset pressure locus representing a squeeze pressure oscillated in accordance with an alternately positive and negative impulsive pressure pattern of an oscillating pressure having a mean value of zero with a predetermined amplitude and frequency versus an elapse of time, and values of actual squeeze pressure measured at sequential sampling time points, so that the squeezing plunger exerts an actual squeeze pressure copying the preset pressure locus against the melt. This type of feedback control is embodied in the embodiments of the present invention as shown in FIG. 1, FIG. 4 and FIG. 5.

Preferably, the alternately positive and negative impulsive pressure pattern may be embodied as a sine curve, but the present invention is not limited to the sine curve. The pattern may be a square, triangle or saw tooth type curve, or any variation thereof.

Figure 2:
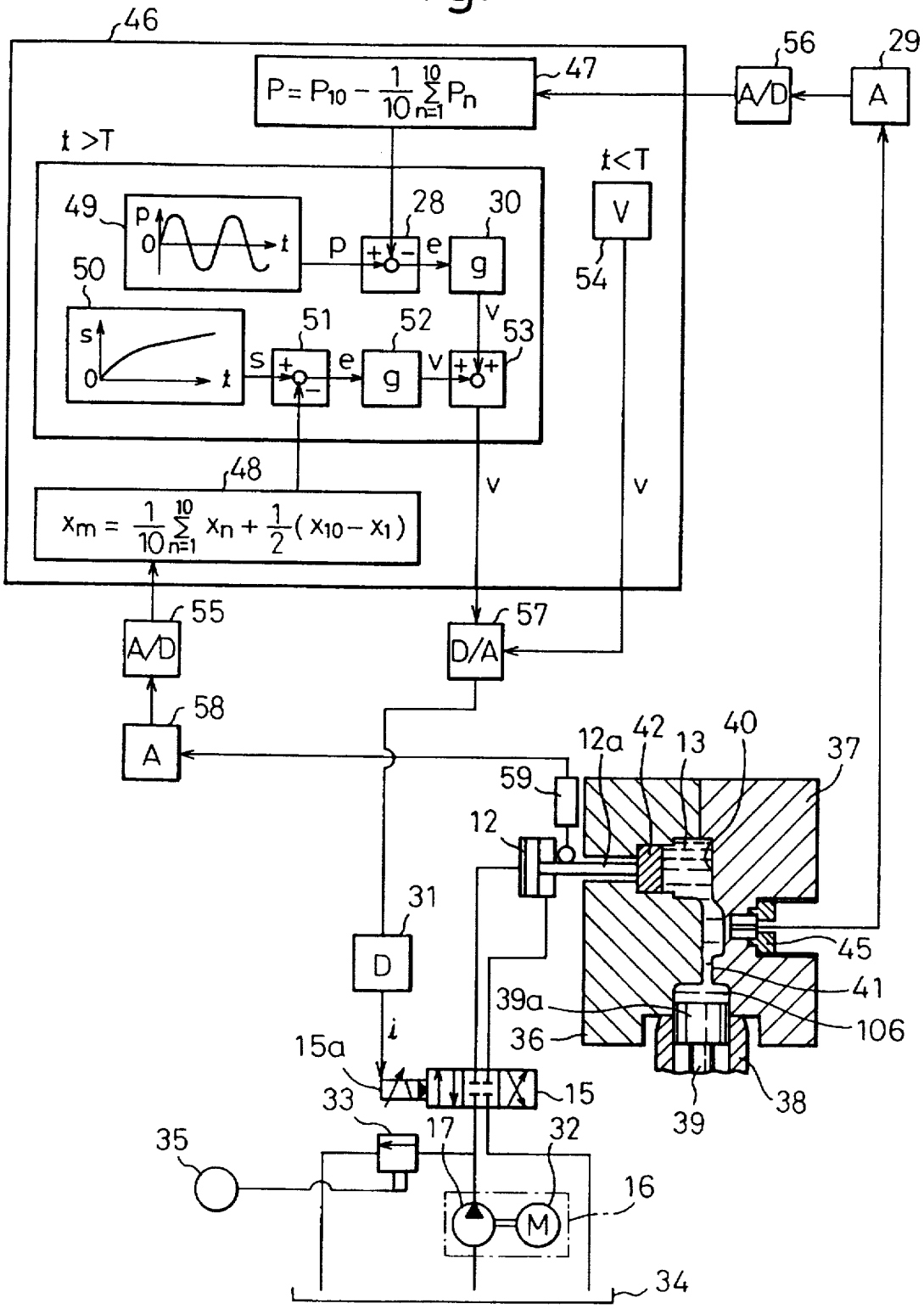
FIG. 2 is a block diagram of another system for controlling the operation of a pressure-casting apparatus according to another embodiment of the present invention.

According to another method, the hydraulic cylinder is feedback-controlled using the above-mentioned impulsive pressure pattern, a predetermined or preset locus representing a non-oscillating stroke versus an elapse of time and values of actual squeeze pressure measured at sequential sampling time points, so that the squeezing plunger exerts the actual squeeze pressure against the melt, a pressure converted from the actual squeeze pressure to have a mean value of zero copying the impulsive pressure locus. This type of feedback control is embodied as shown in FIG. 2.

With the above two feedback control methods, the actual oscillating squeeze pressure is controlled to have a desired mean value or maximum value to compensate for the melt shrinkage in order to prevent occurrence of the melt shrinkage, as a result of the actual stroke being oscillated to have a desired mean value or maximum value to compensate for the melt shrinkage.

Referring to FIG. 1, the control unit comprises: a valve means embodied as a solenoid valve 15*a* for changing a hydraulic pressure in response to a valve drive signal i to control a stroke movement of the squeezing plunger 12*a;* a valve drive means embodied as a driver 31 for generating the valve drive signal in response to a drive command signal v; a means for detecting actual squeeze pressures an generating actual pressure signals corresponding to the detected squeeze pressures at sampling time points with a given time interval, for example, $$\frac{1}{100}$$

seconds between neighboring time points, as embodied as a load cell 25 attached to the support base 20 and an amplifier 29; and a feedback control means or a feedback controller 26.

The feedback controller 26 comprises: a command signal setting means embodied as a pressure model unit 27 for presetting the above-mentioned squeeze pressure locus in accordance with the impulsive pressure pattern and generating a reference pressure signal p corresponding to a squeeze pressure obtained from the preset pressure locus at each sampling time point; and a signal processing means comprising a pressure deviation detector 28 for detecting a deviation of the reference pressure signal from the actual pressure signal at each sampling time point to generate a pressure deviation signal e and a gain setting means 30 for converting the pressure deviation signal e by multiplying an appropriate gain g therefor into the drive command signal v for the driver 31.

Referring to FIG. 4, the apparatus is substantially the same as that of FIG. 1 except for a casting machine being of a vertical die cast machine provided with an injecting hydraulic cylinder 38 having an injection plunger 39 other than the squeezing hydraulic cylinder 12 having the squeezing plunger 12*a*, and a mold composed of a pair of mold halves 36, 36 with a block 42 forming a part of a mold cavity surface and movable relative to the other mold parts in the direction of a stroke movement of the squeezing plunger 12*a*. The block 42 is connected to the squeezing plunger at the forward end thereof. The control unit incorporated in the apparatus is substantially the same as that of FIG. 1. Numeral 45 denotes a pressure sensor mounted in the mold, corresponding to the local cell 25 in FIG. 1.

Referring to FIG. 5, the apparatus is substantially the same as that of FIG. 4 except for a corresponding feedback controller 80 and a corresponding pressure detecting means provided in association with the squeezing hydraulic cylinder, which is adapted to detect actual pressures at sampling time points on the basis of the hydraulic pressures at the rod and head sides of the squeezing hydraulic cylinder 12 and generate actual pressure signals. The pressure detecting means comprises two hydraulic pressure sensors 81, 81*a* for the rod and head side pressures, amplifiers 29, 29*a*, and A/D convertors 56, 56*b*. The feedback controller 80 includes in addition to the same feedback controller 26 of FIG. 1, a calculator 82 for calculating a squeeze pressure from two hydraulic pressure signals generated using the means 81, 81*a*, 29, 29*a*, 56, 56*a* in accordance with a given formula, and generating an actual pressure signal to be input into the pressure deviation detector 28. The given formula is expressed by $$P_0 = \frac{A \cdot P_1 - (A - a) \cdot P_2}{S},$$

where: $P_0$ is an actual squeeze pressure; $P_1$ is a hydraulic pressure at the head side; $P_2$ is a hydraulic pressure at the rod side; A is a sectional area of the cylinder bore; a is a sectional area of the squeezing plunger 12*a;* and S is a sectional area of the block 42.

Referring to FIG. 2, the apparatus is different from that of FIG. 4 only in the control unit. The control unit of FIG. 2, however, is the same as that of FIG. 2 except for a corresponding feedback controller 46 associated with an additional stroke detecting means including a stroke detector 59, an amplifier 58 and an A/D converter 55.

The feedback controller 46 comprises: a first signal setting means embodied as a pressure model unit 49 for presetting the alternately positive and negative impulsive pressure pattern as mentioned above and generate a reference impulsive pressure signal P; a first signal processing means including a pressure deviation detector 28 and a first gain setting means 30; a first calculator 47, in association with a pressure sensor 45 mounted in the mold half 36, an amplifier 29 and A/D converter 56, for generating a differential pressure signal corresponding to a difference between the actual oscillating squeeze pressure at the present sampling time point and an assumed mean value thereof, calculated with the actual pressure signals generated during one cyclic period of time T up to the present sampling time point in accordance with a first given formula; a second signal setting means embodied as a stroke model unit 50 for presetting a desired plunger stroke locus representing a non-oscillating stroke varying to compensate for the melt shrinkage versus an elapse of time and generating a reference stroke signal corresponding to a stroke derived from the preset stroke locus at each sampling time point; a second signal processing means including a stroke deviation detector 51 and a second gain setting means 52; a gain adder 53 for generating a provisional drive command signal from outputs of the first and a second gain setting means 30, 52; a second calculator 48 for generating a mean value stroke signal corresponding to an assumed mean value of the actual oscillating stroke at the present sampling time point, calculated with the actual stroke signals generated during one cyclic period of time T up to the present sampling time point in accordance with a second given formula.

The pressure deviation detector 28 is provided to detect a first deviation of the reference impulsive pressure signal P at the present sampling time point as an output of the pressure model unit 49 from the differential pressure signal as an output of the first calculator to generate an impulsive pressure deviation signal, which is input into the first gain setting means 38.

The stroke deviation detector 51 is provided to detect a second deviation of the reference stroke signal at the present sampling time point as an output of the stroke model unit 50 from the mean value stroke signal as an output of the second calculator 48 to generate a stroke deviation signal, which is input into the second gain setting means 52.

In the first and second gain setting means 30, 52, the input signals are multiplied by appropriate gains to generate output signals, respectively, for the gain adder 53.

The provisional drive command signal as an output of the gain adder 53 is converted into a drive command signal by means of a D/A converter 57 with a signal supplied from a signal generator 54. The drive command signal is input into a driver 31.

The stroke detector 59 is provided to detect an actual stroke movement of the squeeze plunger 12*a* at each sampling time point and generate an actual stroke signal to be input into the second calculator 48 via the amplifier 58 and then the A/D convertor 55.

The first given formula is $$P = P_{10} - \frac{1}{10} \sum_{n=1}^{10} P_n,$$

where the given sampling time interval between neighboring sampling time points is, in the embodiment, one tenth (1/10) of a predetermined cyclic period of time T, and $P_n$ is a measured squeeze pressure value at each sampling time point n in the cyclic period T up to the present sampling time point (n=10).

The second given formula is:

$$X_m = \frac{1}{10} \sum_{n=1}^{10} X_n + \frac{1}{2} (X_{10} - X_1),$$

wherein $X_m$ is an assumed mean value of the actual oscillating stroke at the present sampling time point, and $X_n$ is a measured stroke value at each sampling time point n in the cyclic period T up to the present sampling time point. The second given formula is derived from the following relationship between the assumed mean value and the measured values during one cyclic period T.

Referring to FIG. 3, assuming that: a mean value locus is inclined as designated by M; an oscillating stroke has a constant amplitude and frequency; $S_1$ is a value of the oscillating stroke (at a position A) at the present sampling time point; $S_2$ is a value of the oscillating stroke (at a position B) at a past sampling time point prior to the present sampling time point prior to the present sampling time point by one cyclic period T, $S_3$ is an arithmetic mean of the measured stroke values during the cyclic period T, which corresponds to a position C in the assumed mean locus M, and is equivalent to $$\frac{1}{10} \sum_{n=1}^{10} X_n.$$

In this connection, $S5=S_1-S_2$, and $$S_6 = \frac{1}{2} S_5 = \frac{S_1 - S_2}{2},$$

which is equivalent to $\frac{1}{2}(X_{10}-X_1)$. Therefore, $X_m$ is $S_4=S_3+S_6$,
which is equivalent to $$\frac{1}{10} \sum_{n=1}^{10} X_n + \frac{1}{2} (X_{10} - X_1).$$

In a case where a desired stroke locus to compensate for the melt shrinkage has a gentle gradient having a small value relative to the given amplitude or a gradient close to zero, $X_m$ may be $$\frac{1}{10} \sum_{n=1}^{10} X_n$$

with the term of $\frac{1}{2}(X_{10}-X_1)$ being neglected. In another case where a desired stroke locus to compensate for the melt shrinkage locus to compensate for the melt shrinkage has a relatively sharp slope or gradient, the term of $\frac{1}{2}(X_{10}-X_1)$ cannot be neglected.

The two sampling positions A and B in FIG. 3 are those of neighboring maximum values of the oscillating stroke locus. However, in order to satisfy the above relationship, they are not limited as such, but may be any two positions with a gap of the cyclic period T therebetween.

The cyclic period T is equivalent to an inverse number of a given frequency of the oscillating stroke or squeeze pressure. The given time interval between neighboring sampling time points is not limited to 1/10 of the cyclic period T as embodied in FIG. 2. Further, the first and second formulas may be applied with the measuring pressure and stroke values during not only one cyclic period T but also two or more cyclic periods as needed.

Figure 9:
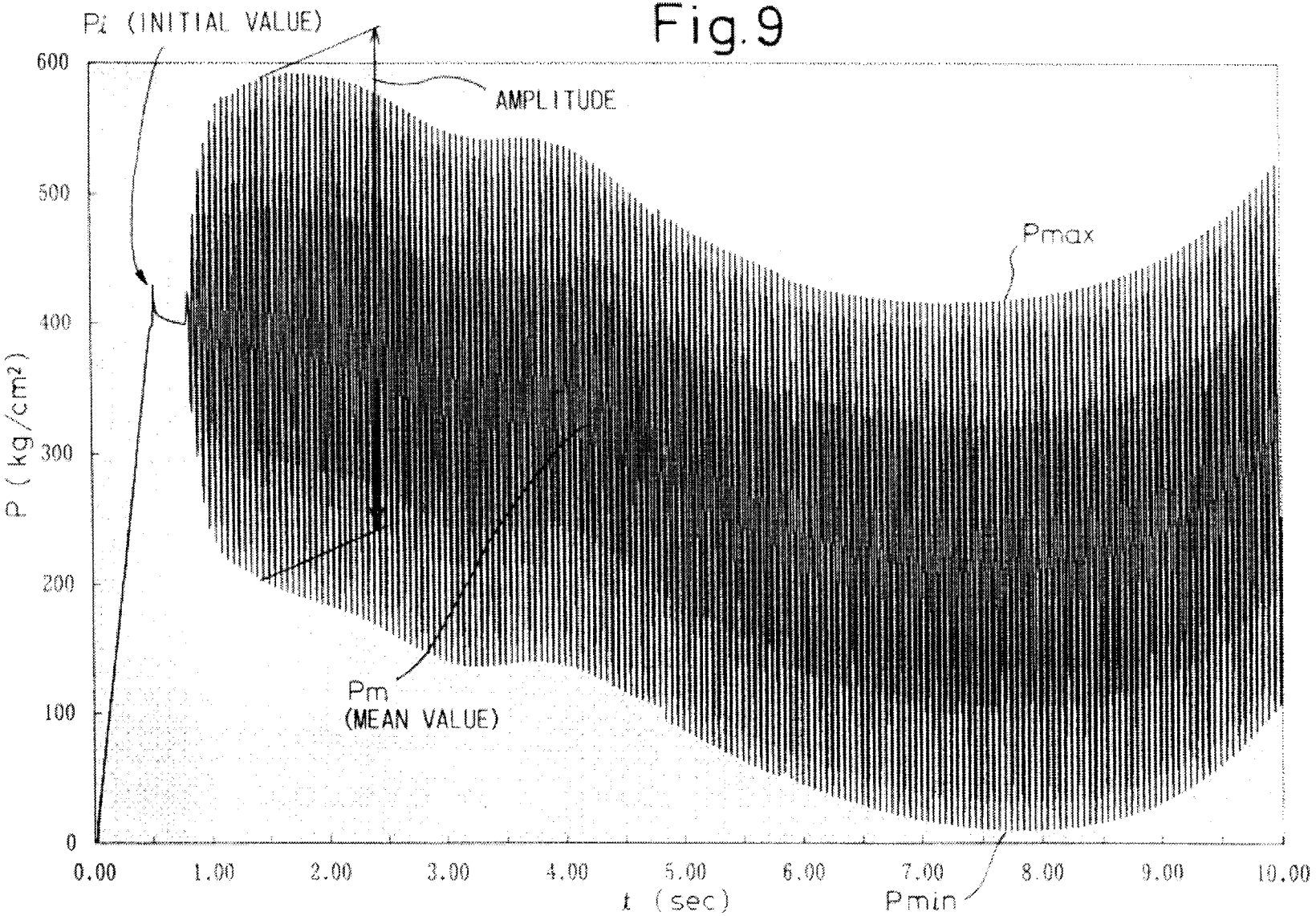
FIG. 9 is an actual graph indicating an actual oscillating pressure versus an elapse of time, generated according to another embodiment of the present invention, the graph having been prepared using a graphic pressure recorder.
Figure 10:
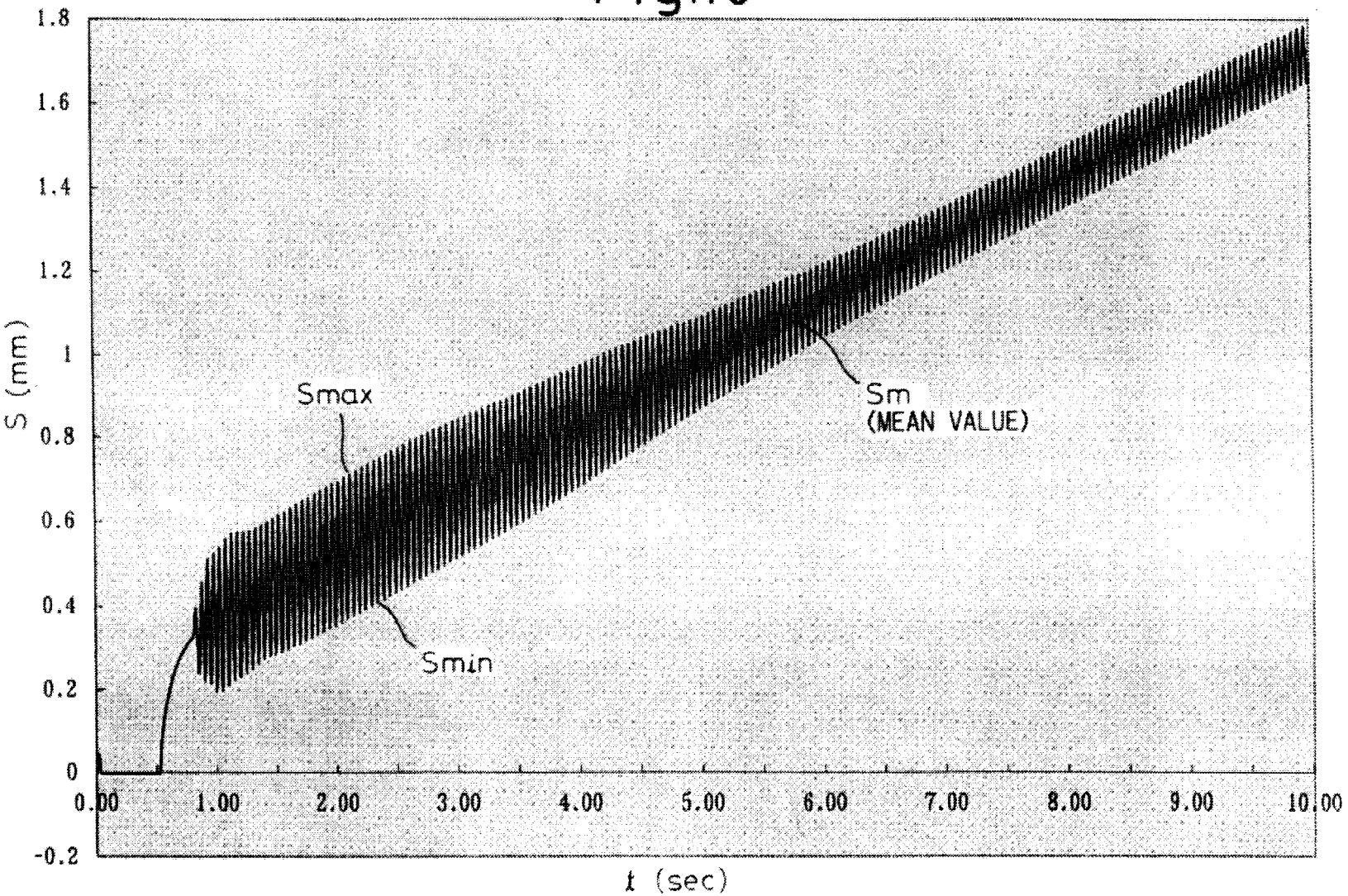
FIG. 10 is an actual graph indicating an actual oscillating stroke versus an elapse of time generated when the oscillating pressure as shown in FIG. 9 is generated in the same embodiment, the graph having been prepared using a graphic stroke recorder.

With the above mentioned apparatus as shown in FIG. 2, the injection plunger 39 is operated to fill a melt into the mold cavity 40 and is kept exerting a predetermined pressure to the melt in a subsequent squeezing pressure process. After the melt is injected, the squeezing plunger **12*a* is forced to advance by about 3 mm as indicated, for example, in FIG. 10 to increase a squeeze pressure to the melt up to 400/cm$^2$, while the squeezing plunger is not oscillated. Subsequently, the control unit is operated to control the squeeze pressure for 10 to 20 seconds as needed so as to be oscillated to have a constant amplitude of 400 kg/cm$^2$ or ±200 kg/cm$^2$ and a constant frequency of 20 Hz with the squeezing plunger 12*a* being oscillated to have a mean value varying to copy the preset non-oscillating stroke locus. When the squeezing plunger is forced to stop, the squeezing pressure process is terminated, since the stopping of the squeezing plunger means complete solidification of the melt. The oscillated squeeze pressure is shown in FIG. 9. As seen from FIG. 9, the squeeze pressure was oscillated to have the preset amplitude of 400 kg/cm$^2$ and the preset frequency of 20 Hz, but with a mean value being not kept constant but varied while the melt was being solidified, contrary to the other embodiments as shown in FIGS. 1, 4 and 5 (see FIG. 8). This is because the control unit of FIG. 2 does not control a mean value of the oscillating squeeze pressure. The reason why the actual mean value of the oscillating squeeze pressure is decreased gradually during an initial stage of the squeezing pressure process and then increased gradually during a final stage as shown in FIG. 9 is that a part of the melt injected in the mold which is filled in a gate 41 of the mold is not rapidly solidified during the initial stage while the injection plunger is movable under the predetermined hydraulic pressure applied by the injecting hydraulic cylinder 38. If the melt part in the gate 41 is solidified enough to prevent the injection plunger 38 from being moved rearwardly due to an advance stroke movement of the squeezing plunger 12*a*, the mean value of the oscillating squeeze pressure is turned to increase gradually as shown in FIG. 9**.

Figure 20:
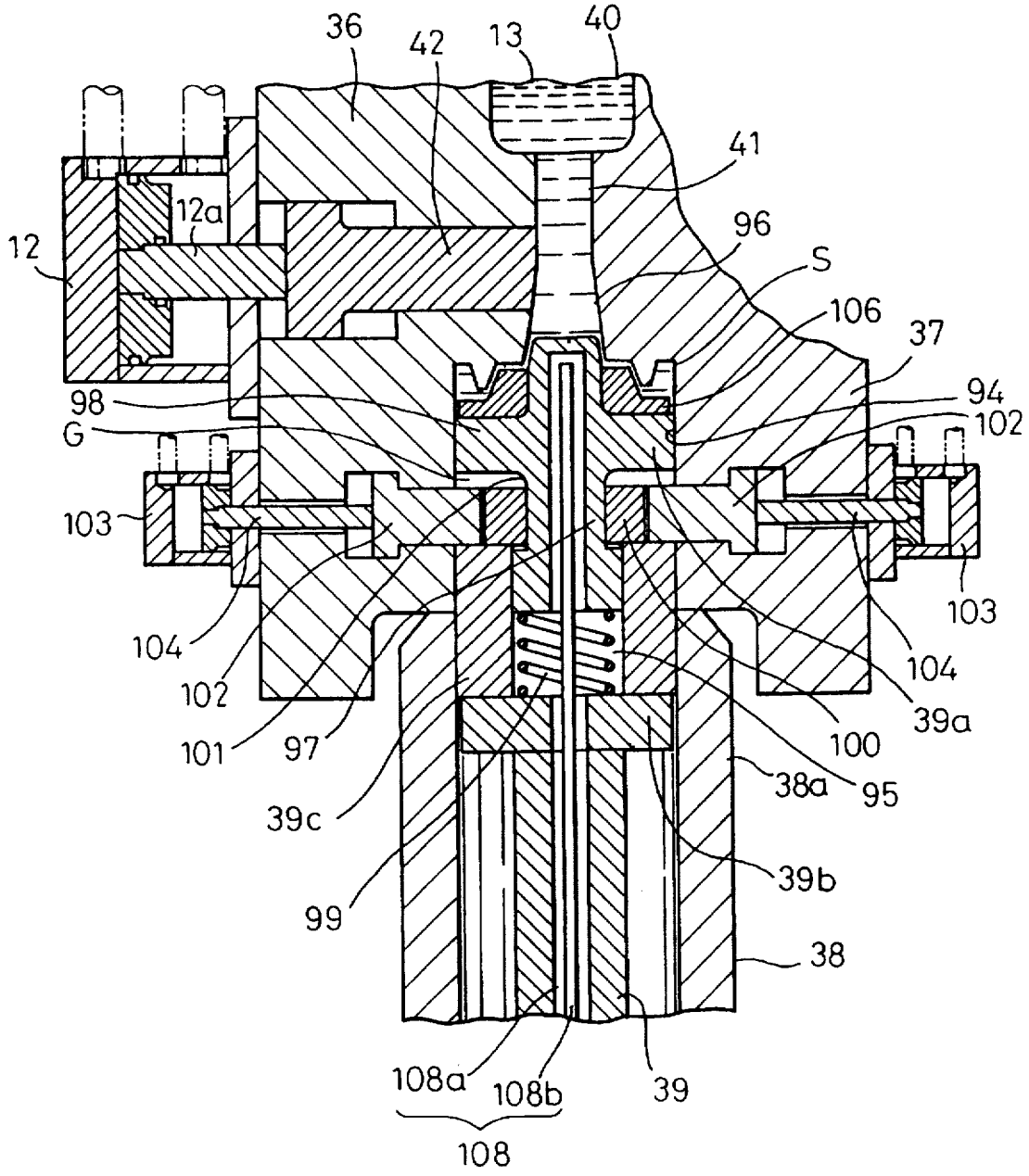
FIG. 20 is a sectional view showing a system comprising a squeezing hydraulic cylinder with a squeezing plunger movable into the gate of a mold and an injecting hydraulic cylinder with an injection plunger incorporated with a stopper means, in an apparatus of the present invention.
Figure 21:
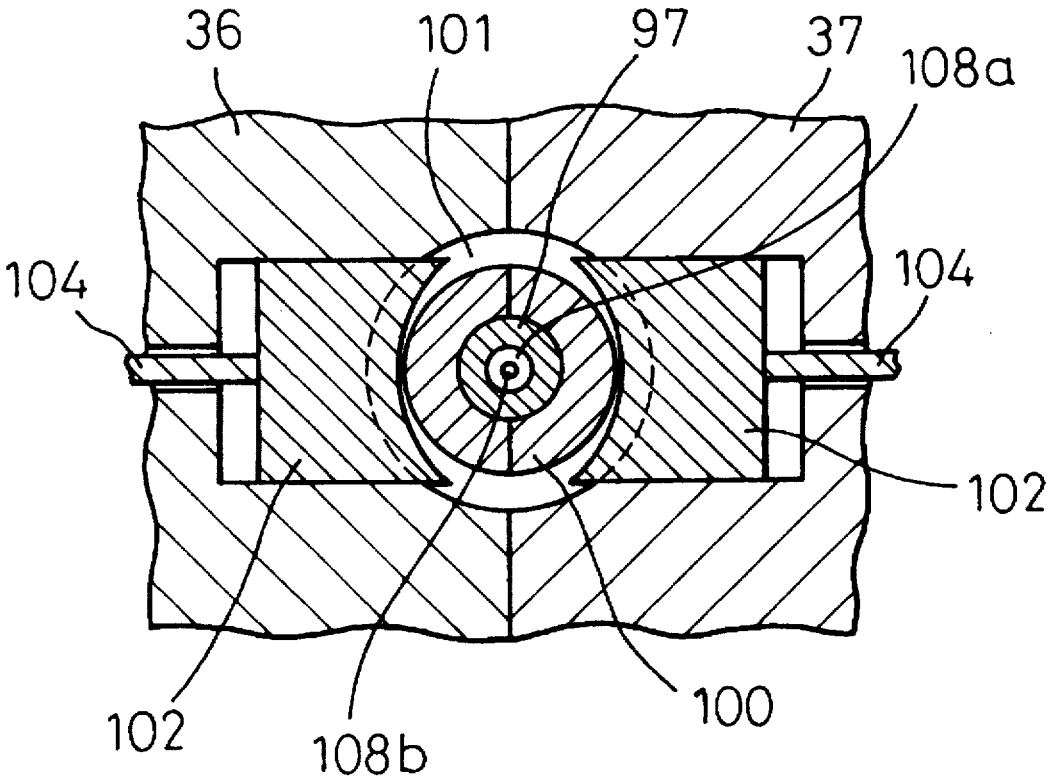
FIG. 21 is a cross-sectional view taken along line A—A in FIG. 20, showing stopper means engaged with an injection plunger in the apparatus of FIG. 20.

In connection with this, it should be noted that if the injection plunger is initially stopped by means of an appropriate stopper, for example, as shown in FIG. 20 or 21, such a decreasing mean value of the oscillating squeeze pressure as shown in FIG. 9 would not be generated.

A desired oscillating squeeze pressure having a given mean value with a given amplitude and frequency to be applied in accordance with the present invention depends on the kind of metal alloy, geometry of a cast article, casting conditions and the like. The mean value, amplitude and frequency must be determined by trial and error in test casting operations. In most cases, these pressure parameters (i.e., mean value, amplitude and frequency) may be set to be constant values over a substantial squeezing pressure process. However, in some other cases, preferably these parameters may be functions of time, depending on, particularly, geometry of a mold cavity.

In general, a case where the frequency is less than 2 Hz and the amplitude is 20 kg/cm$^2$, that is, ±10 kg/cm$^2$ does not exhibit any substantially positive effect on a cast article of any kind of metal alloy. In order to obtain a significantly positive effect, it is desired to oscillate the squeeze pressure so as to have a frequency of not less than 5 Hz and an amplitude of not less than 40 kg/cm$^2$.

By the way, under the present technology, it is impossible to provide a pressure-casting machine operable under an oscillating pressure condition where the frequency is more than 500 Hz and the amplitude is more than 1000 kg/cm$^2$. Further, even if the casting machine were strong enough to be capable of operating under such a severe condition as above, the machine would become considerably expensive. In this regard, in general, preferable frequency and amplitude may be not more than 200 Hz and 500 kg/cm$^2$, respectively. With respect to a mean value of the ,oscillating squeeze pressure, not less than 200 kg/cm$^2$ is required even at an initial stage of the squeezing pressure process, but in a case of a cast alloy where the melt shrinkage is likely to occur extensively during the melt solidification process due to the kind of alloy and/or geometry of a mold cavity, a preferable mean value may be not less than 400 kg/cm$^2$.

For instance, with a metal alloy having a tendency of generating equiaxed crystals, such as AC7A or AZ91, it is preferable to oscillate the squeeze pressure so as to have a mean value of 200 to 400 kg/cm$^2$ with a frequency of 10 Hz or so and with an amplitude of a level of ±20 kg/cm$^2$ in the alloy of AC7A and a level of ±40 kg/cm$^2$ in the alloy of AZ91. In a case of an alloy having a low thermal strength such as AZ91, if an oscillating squeeze pressure with an amplitude of more than ±100 kg/cm$^2$ is applied, such a high amplitude leads to occurrence of hot tearing or cracking.

With an alloy having a lower amount of solute elements and thus having a tendency of banding segregation occurring, such as AC4CH, an oscillating squeeze pressure is required to have an initial mean value of 400 kg/cm$^2$ or so with an amplitude of not less than ±100 kg/cm$^2$. With respect to a frequency 20 Hz is confirmed as a value exhibiting some positive effect, and a high frequency such as 70 Hz exhibits a significantly positive effect.

With a cast alloy of AC4CH and an apparatus of the present invention as shown in FIG. 20, details of which will be explained herein later, a pressure-casting method was carried out under the conditions that: a melt temperature is 780° C.; a casting hydraulic pressure is 400 kg/cm$^2$; and an initial mean value of a squeeze pressure to be applied is 400 kg/cm$^2$, in such a manner that a squeezing plunger 12*a* is advanced with a non-oscillating stroke speed of 3 mm/sec for one second and then the squeeze pressure process is commenced and continues for 19 seconds.

In a first case where the squeeze pressure was not oscillated and thus had an amplitude of 0 kg/cm$^2$ and a frequency of 0 Hz, it was confirmed that there were banding segregations of Si having a length of 1 mm or more and a width of 200 μm or more appearing in a cast article.

In a second case where the squeeze pressure was oscillated to have an amplitude of ±500 kg/cm$^2$ and a frequency of 20 Hz, banding segregation of Si was reduced to some extent relative to that in the first case. However, there was no significant difference between the first and second cases in a result of a tensile test of both the cast articles, which showed an elongation percentage of about 10% and a tensile strength of about 30 kg/cm$^2$.

In a third case where the squeeze pressure was oscillated to have an amplitude of ±200 kg/cm$^2$ and a frequency of 70 Hz, there disappeared such a banding segregation from a cast article. The tensile test result shows that the strength quality of the cast article was improved such that the elongation percentage was increased from 10% to 12.5% so as to be 1.25 times the value of the first and second case, and the tensile strength was increased by 1 kg/mm$^2$ to 31 kg/cm$^2$ from 30 kg/cm$^2$ of the first and second cases.

In general, it is recognized that harder a cast article becomes, more brittle it becomes, and thus if either the elongation or the tensile strength were increased, the other would be decreased. In this regard, it is surprising for the third case to have both the elongation and tensile strength increased as above.

In comparison, a pressure-casting method using the apparatus as shown in FIG. 1 was carried out with an alloy of AC7A at a melt temperature of 800° C. In a case where a non-oscillating squeeze pressure of 600 kg/cm$^2$ was applied to the melt, a cast article of AC7A had columnar crystals 22 dominantly grown inwardly from the article surface to surround a central region where a lower amount of equiaxed crystals 23 were generated as shown in FIG. 14. In turn, in an inventive case with the same melt temperature of 800° C. where a squeeze pressure oscillated to have a mean value of 540 kg/cm$^2$ with an amplitude of ±50 kg/cm$^2$ and a frequency of 10 Hz, a cast article of the same alloy, AC7A, had equiaxed crystals 23 generated dominantly and distributed throughout the entire region with grain refinement as shown in FIG. 15. Even if the amplitude is reduced to +20 kg/cm$^2$ provided that the mean value is increased to 570 kg/cm$^2$ so that a maximum value is kept to be 590 kg/cm$^2$ to compensate for the melt shrinkage, a cast article is obtained with a refined metal structure having equiaxed crystals, so long as the frequency is increased to a level of 50 Hz.

The above embodied casting processes or methods were carried out with common aluminum alloys and magnesium alloys, but such casting processes may be carried out with a melt of alloy with a reinforcing material mixed therein, such as ceramic fibers, whiskers or particles.

For instance, a pressure-casting method using an apparatus as shown in FIG. 20 can be carried out to apply an oscillating squeeze pressure having a mean value of 700 kg/cm$^2$ with an amplitude of ±100 kg/cm$^2$ and a frequency of 100 Hz to a melt of aluminum alloy 6061 containing 20% by volume of SiC particles as a reinforcing material at an initial melt temperature of 750° C. for about 20 second, with the result that a metal structure of a cast article has equiaxed crystals generated dominantly throughout the entire region.

Figure 16:
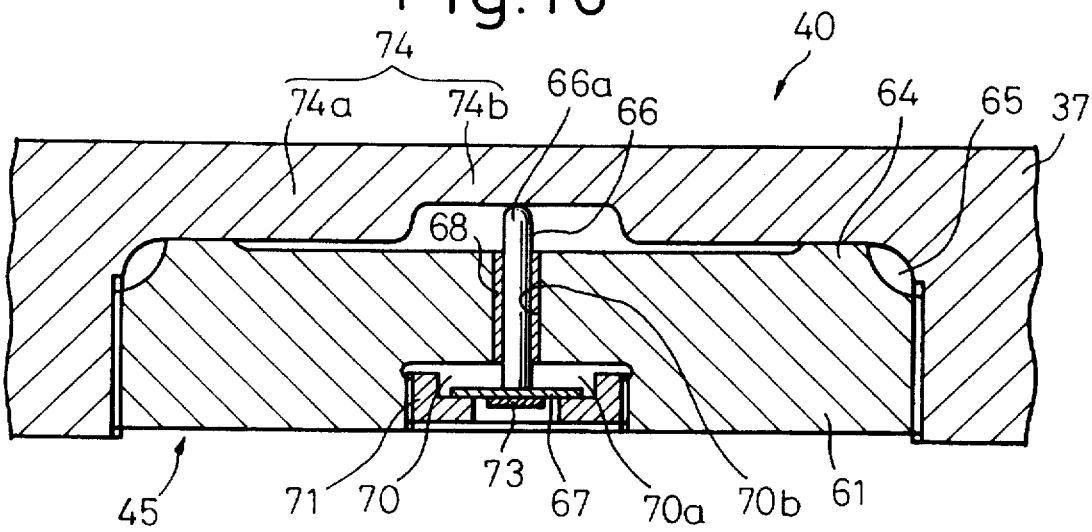
FIGS. 16 and 17 are sectional views of pressure detecting means comprising a strain gage for detecting an oscillating melt pressure, incorporated in a casting mold used in the control system according to the present invention, respectively.

Referring to FIG. 2 or 4, the apparatus of the present invention is provided with a means for detecting actual oscillating pressure applied to the melt in the mold cavity or a sensor designated by reference numeral 45. This pressure sensor 45 is embodied preferably as shown in FIG. 16. Referring to FIG. 16, the pressure sensor 45 comprises: an oscillating means including a cavity wall portion of a mold half 37 depressed to form a circumferential side wall and a yielding thin bottom wall 74 defining a small portion of a mold cavity 40 and having a circumferential thicker portion 74*a* and a central thinner portion 74*b*; and a block 61, having a central stepped hole 70 consisting of an outer enlarged, threaded portion 70*a* and an inner constricted portion 70*b* with a circumferential projection 64 formed at the inner surface of the block 61. The side wall of the depressed mold portion is threaded, and the block 61 is mounted by a screw connection in the depressed mold portion to abut at the circumferential projection 64 against the circumferential thicker portion 74*a* of the local wall with a certain axial gap between the block 61 and the bottom wall 74 in the region surrounded by the circumferential projection 64. The oscillating means is provided to enable the bottom wall 74 to oscillate in response to an oscillation of the melt 13 due to the oscillating squeeze pressure.

The sensor 45 further comprises: a yield measuring disk plate 67 located in the outer enlarged portion 70*a* of the block hole; a yield transmitting rod 66 extending through the inner constricted portion 70*b* of the block hole and disposed between the central thinner portion 74*a* of the thin local wall and the yield measuring plate 67 in contact therewith; a threaded supporting member 71 screwed to the block 61 in the outer enlarged, threaded portion 70*a* of the block hole for supporting the yield measuring plate 67 at the outer side thereof; and a strain gauge 73 attached to the yield measuring plate 67 at the outer side thereof for detecting a strain thereof.

The threaded supporting member 71 is of a ring for having a stepped central hole, and the yield measuring plate 67 rests on a circumferential step of the supporting member 71 at a peripheral portion of the plate 67, while the yield transmitting rod 66 extends from a center of the plate 67 to abut against a center of the central thinner portion 74*b* of the bottom wall at a free tip end 66*a* of the rod. The rod tip end 66*a* may be conical or spherical.

The circumferential or annular projection 64 of the block 61 is formed adjacent to a circumferential groove 65 formed at a circumferential corner of the block, so that there is an annular space gap between the depressed portion of the mold and the block at the corner thereof. The reference numeral 68 designates a bush disposed in the constricted portion 70*b* of the block hole, through which the rod 66 is axially slidable.

The strain gauge 73 is a common one available commercially, and is connected to a body of a strain gauge instrument (not shown).

According to the above sensor arrangement, a strain of the yield measuring plate 67 is proportional to that of the thin local wall 74 of the mold generated in response to the melt pressure, and thus a value of the measuring plate strain measured by the strain gauge instrument can be converted easily into a value of the melt pressure by an appropriate calculation using necessary parameters regarding the dimensions of the members involved in the sensor arrangement. The thus calculated and converted value of the melt pressure can be output as a melt pressure signal for use in the feedback control according to the present invention.

Figure 18:
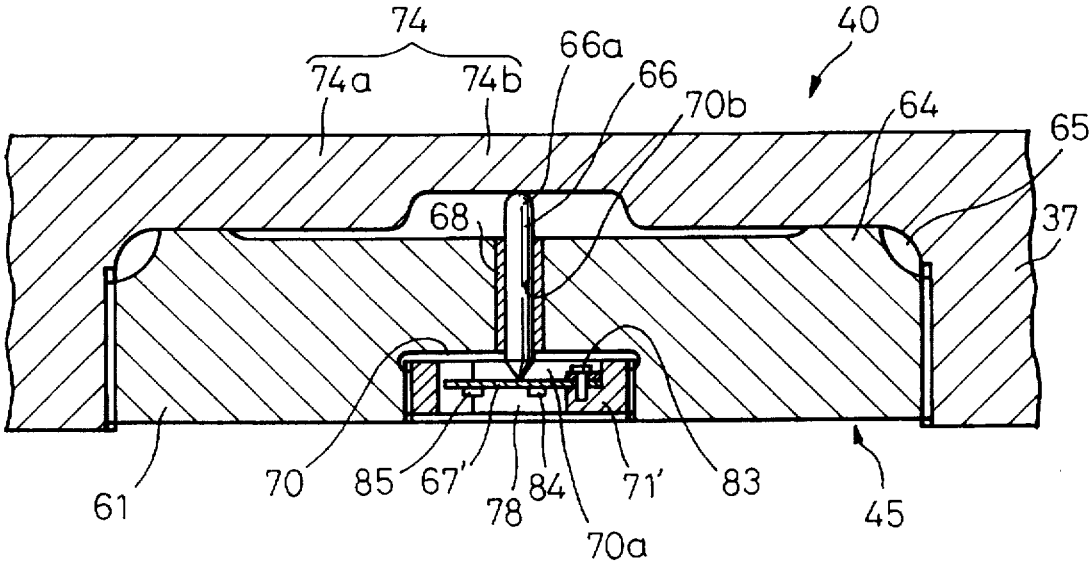
FIG. 18 is a sectional view of a pressure detecting means comprising a displacement sensor for detecting an oscillating melt pressure, incorporated in a casting mold used in the control system according to the present invention.
Figure 19:
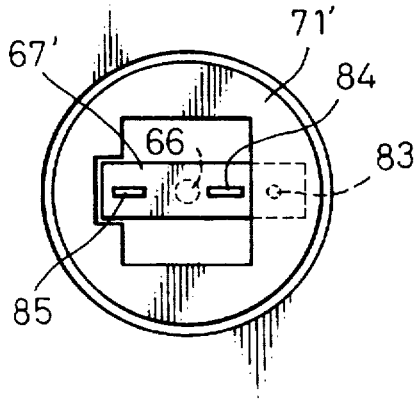
FIG. 19 is a bottom view showing a central portion of the pressure detecting means as shown in FIG. 18.

FIG. 18 shows another embodiment of the pressure sensor 45 according to the present invention, modified from that of FIG. 16 in order to improve accuracy of the pressure measurement. The modification is directed to only a combination of a corresponding threaded supporting member 71 having a hole 78 and a corresponding yield measuring plate 67 of a lever form with two strain gauges 84, 85 attached thereto. The supporting member 71' and the yield measuring plate 67' are contoured as shown in FIGS. 18 and 19, and the yield measuring plate 67' is fixed by a bolt 83 to the supporting member 71' at its one end to form a cantilever. The two strain gauges 84, 85 are attached with a corresponding yield transmitting rod 66 abutting against the cantilever at a point between the two strain gauges 84, 85. The two strain gauges 84, 85 may be attached to the cantilever at either an inner side or an outer side thereof.

According to the modified sensor as shown in FIG. 18, the strain gauge 85 located at a free end side of the cantilever yield measuring plate 67' relative to the rod 66 detects not a pressure strain of the yield measuring plate 67' generated in response to the melt pressure but a thermal strain of the plate in response to a temperature of the plate, whereas the other strain gauge 84 located at side of the bolt 83 detects the pressure strain of the plate 67'. In this connection, a value of the melt pressure in the mold is obtained by an appropriate calculation with the data detected by the two strain gauges 84, 85 being made so that an error of a pressure value derived from the pressure strain from an actual melt pressure, produced due to the thermal strain, is eliminated by compensating for the thermal strain factor contributing to the detected pressure value. In this regard, the pressure sensor of FIG. 18 may be called "a temperature factor compensating sensor". The strain gauge 85 detecting the thermal strain may adopt as its circuit a so-called "active dummy bridge circuit", while the other strain gauge 84 detecting the pressure strain may adopt as its circuit a so-called "wheatstone bridge circuit".

Figure 17:
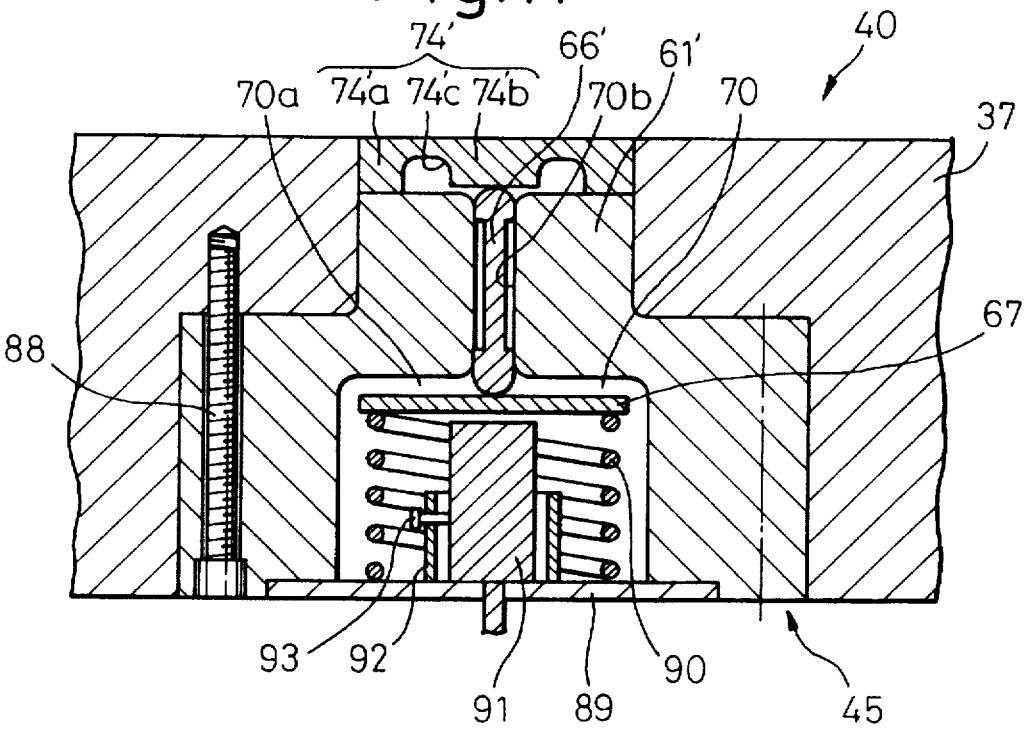

FIG. 17 shows a still another embodiment of the pressure sensor 45 according to the present invention. Referring to FIG. 17, the pressure sensor 45 comprises: an oscillating means including a stepped holed formed in a mold half 37 to open to a mold cavity having an outer enlarged hole portion and an inner constricted hole portion; a yielding thin local wall member 74' tight-fitted in the inner portion of the stepped mold hole to define a small portion of the mold cavity at the inner end surface thereof and including a circumferential thicker wall portion 74'*a*, a central thinner wall portion and an intermediate groove wall portion 74'*c*; and a block 61', having a central stepped hole 70 consisting of an outer enlarged portion 70*a* and an inner constricted portion 70*b* mounted in the outer enlarged portion of the mold hole to abut at the inner constricted portion 70*b* against the circumferential thicker portion 74*a* of the wall member with a certain axial gap between the block 61' and the wall member 74' in the region surrounded by the circumferential thicker wall portion 74'*a*. The thin wall member 74' may be detachably fixed to the block 61' by bolts, but need not be always fixed as such, since the thin wall member 74' is urged toward the block 61' by a high melt pressure. The block 61' with the thin wall member 74' attached or fixed thereto is secured to the mold wall by bolts 88, after it is disposed into the stepped mold hole. The oscillating means as assembled is provided to enable the thin wall member 74' to oscillate in response to an oscillation of the melt due to the oscillating squeeze pressure.

The pressure sensor 45 of FIG. 17 further comprises: a yield measuring disk 67 located in the outer enlarged portion 70*a* of the block hole 70; a yield transmitting rod 66' extending through the inner constricted portion 70*b* of the block hole and disposed between the central thinner portion of the local wall member 74' and the yield measuring disk 67 in contact therewith; a coil spring 90 located in the outer enlarged portion 70*a* of the block hole and biasing the yield measuring disk 67 against a cover plate 89 detachably fixed to the block 61' to cover the block hole 70; and an inductive displacement sensor 91 attached to the cover plate 89 at the inside thereof and encircled by the coil spring 90 for detecting an axial gap between the displacement sensor 91 and the yield measuring disk 67. A cylindrical support member 92 with a plurality of adjusting bolts 93 is fixed to the cover plate 89 with the displacement sensor 91 being disposed in the support member 92 and secured thereto by the bolts 93. The bolts 93 are adapted to fine-adjust a lateral position of the axially extending displacement sensor 91.

The yield transmitting rod 66' has opposite free enlarged end portions and an immediate portion therebetween with a diameter reduced so that the rod 66' can be slidable through the inner constricted portion 70*b* of the block hole with a reduced sliding friction between the block 61' and the rod 66'.

The inductive displacement sensor 91 may be of an eddy current type for use in a high temperature environment, which is available commercially.

Preferably, the yield transmitting rod 66' may be of a material such as $Si_3N_4$, which has small thermal expansion and heat conductive coefficients in order to eliminate a possible measurement error due to a thermal expansion of the rod.

Figure 11:
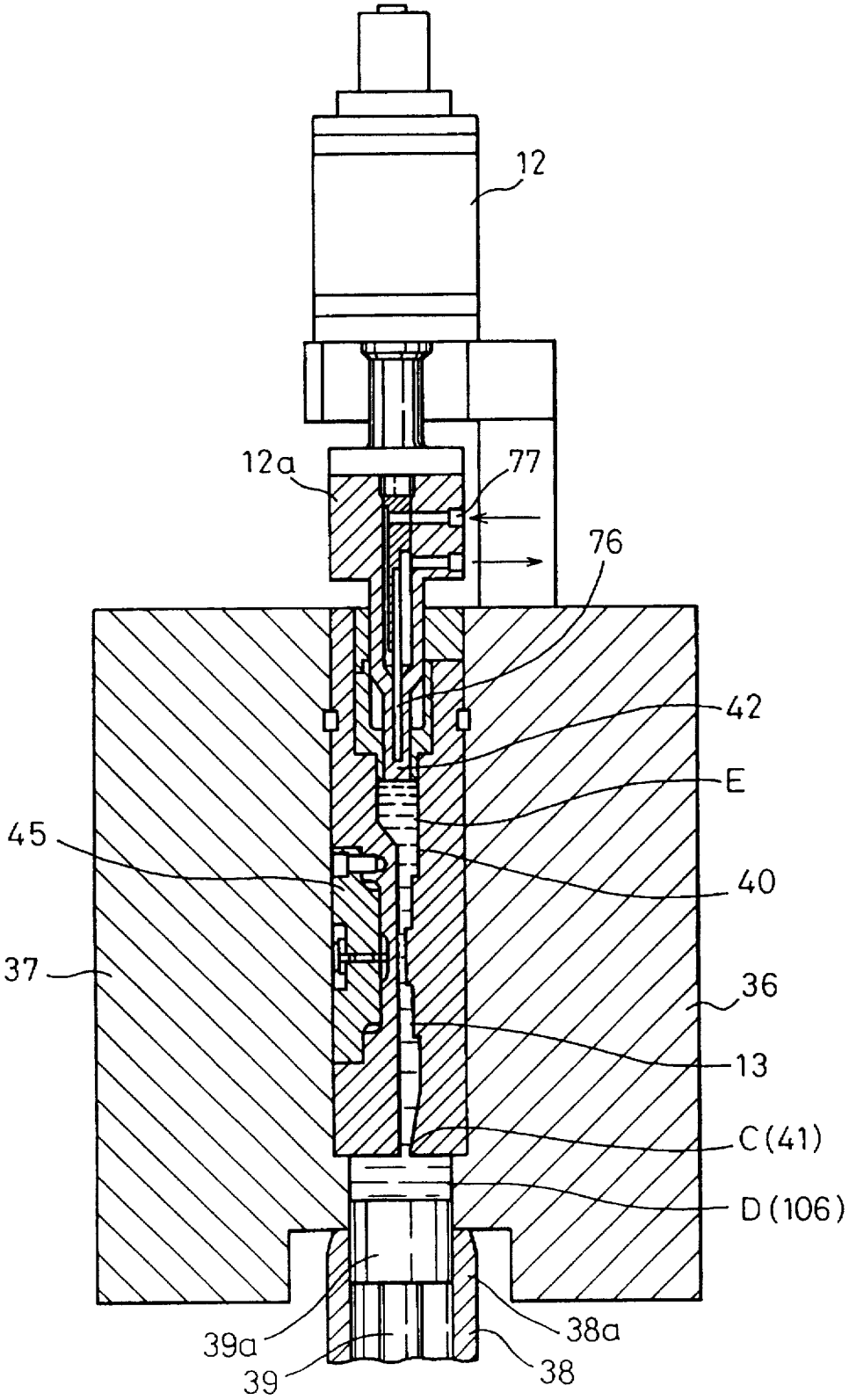
FIG. 11 is a sectional view showing a main part of a prototype pressure-casting apparatus according to the present invention.

FIG. 11 shows an embodiment of an injection type of a vertical die casting machine incorporated in the apparatus of the present invention. With this machine, a squeezing plunger 12*a* of a titling squeezing hydraulic cylinder 12 is mounted on the top of a mold composed of mold halves 36 and 37 defining a mold cavity 40 for a generally thin cast article. The squeezing plunger 12*a* has a head 42 to be exposed to the mold cavity 40 and is arranged so as to be movable vertically along a parting line of the mold halves into an enlarged, upper end portion E of the mold cavity 40, while an injection plunger 39 of a tilting type injecting hydraulic cylinder 38 mounted below the bottom of the mold is arranged so as to be movable vertically along the parting line toward a gate or a constricted, lower end portion C of the mold cavity 40. A pressure sensor 45 is incorporated in the mold half 37 at a central region of the mold cavity 40.

With this arrangement, a stroke movement of the squeezing plunger 12*a* causes the head 42 of the plunger to exert an effective squeeze pressure against a melt 13 in the mold cavity 40 throughout the entire melt. The squeezing plunger 12*a* is provided with a heat pipe system 76 therein, which is adapted to prevent a melt part in the enlarged upper end portion E of the mold cavity from being cooled rapidly at an initial stage of the squeezing pressure process to thereby ensure an effective oscillation of the melt to be effected by the squeezing plunger 12*a*. The squeezing plunger 12*a* is also provided with a cooling system 77 therein, an operation of which is switched to start at a final stage of the squeezing pressure process from the operation of the heat pipe system 76 in order to rapidly cool the head of the squeezing plunger 12*a* to thereby complete the solidification of the melt.

The mold is contoured internally to have a cylindrical chamber D communicating with the gate or constricted lower end portion C, in which chamber an enlarged head 39*a* of the injection plunger 39 is slidably movable. An excess part of the entire melt injected into the mold is filled in the chamber D between a portion of the mold at the gate C and the head 39*a* of the injection plunger, while the injecting hydraulic cylinder 38 is operated to apply a predetermined hydraulic pressure to the injection plunger 39 after completion of the injection process. At the initial stage of the squeezing pressure process during which the gate C is not closed completely by a solidified melt part, a part of the non-solidified melt is forced to enter into the chamber D when the squeezing plunger 12*a* advance into the mold cavity 40 to exert a maximum value of the oscillating squeeze pressure to thereby have a volume of the chamber D increased with the injection plunger being retracted accordingly. In this connection, it is preferable to determine a desired oscillating squeeze pressure locus to be copied according to the control method of the present invention by an actual squeeze pressure applied to the melt in the mold cavity 40 so as to have a desired mean value to compensate for the melt shrinkage.

The melt part in the chamber D is finally solidified to form a so called "bisket" to be separated from a cast article when the article is removed from the mold. Undesired air bubbles in the injected metal are forced to escape from the cavity and gate into the chamber D due to the high melt pressure with the result that the bubbles are concentrated in the bisket.

FIG. 20 shows another embodiment of a machine corresponding to that of FIG. 11, according to the present invention. Referring to FIG. 20, the machine is different from that of FIG. 11 in the following constructive features.

A mold composed of a stationary mold half 36 and a movable mold half 37 having vertical parting surfaces defining a vertical parting line has a hollow space consisting of a mold cavity 40 for a cast article, a vertically extending gate 41 and a cylindrical chamber 94 modified from that D of FIG. 11. A squeezing plunger 12*a* of a squeezing hydraulic cylinder 12 has a head 42 of a block form extending transversely toward the gate 41 and forming a surface portion of the gate at the end surface of the head 42.

An injection plunger 39 of a tilting type injecting hydraulic cylinder 38, slidably mounted in a sleeve 38*a* thereof has a plunger tip 39*a* enlarged to be slidably fitted with the cylindrical chamber 94. The plunger tip 39*a* has a front constricted portion 96 to be fitted in the gate 41, a radially enlarged intermediate portion 98 and a rear constricted and elongated portion 97 extending axially. A supplemental bisket member 106 of a ring form having a central hole is removably mounted on the enlarged intermediate tip portion 98 at a front surface thereof with the front tip portion 96 being fitted in the bisket member 106 and extending therethrough. The supplemental bisket member 106 has a stepped circumferential surface consisting of an inner plate portion and a stepped-down outer portion. The cylindrical chamber 94 of the mold hollow space has a circumferential inner bottom surface at which the gate 41 is open to the chamber 94. The inner chamber bottom surface has a stepped surface consisting of an inner portion, an intermediate stepped-up and down portion forming a rearwardly projected portion and an outer portion horizontally aligned with the inner portion. The plunger tip 39*a* with the supplemental bisket member 106 and the mold defines a space S with a stepped gap in the chamber 94 between the stepped front or top surface of the bisket member 106 and the stepped bottom surface of the chamber 94. The space S thus defined in the chamber consists of an inner constricted portion and an outer enlarged portion as shown in FIG. 20, and is variable in volume in accordance with a stroke of the injection plunger. The injection plunger stroke is varied when the squeezing plunger 12*a* is moved at the gate 41 against a melt 13 filled in the mold hollow space as explained with reference to FIG. 11.

The injection plunger 39 has an enlarged head 39*b* having a flat end surface with a cylindrical member 39*c* slidably fitted in the injection sleeve 38*a* of the injecting hydraulic cylinder 38 and fixed to the plunger head 39*b* at the end surface thereof. The rear elongated portion 97 of the plunger tip 39*a* has an enlarged free end slidably fitted in the hole 95 of the cylindrical member 39*c* with a coil spring 99 accommodated in the cylindrical member 39*c* between the plunger head 39*b* and the free end of the rear tip portion 97. With the above arrangement, a pair of half rings are fixed to each other to form a ring 100, through which the constricted portion 97 of the plunger tip 39*a* extends, and also fixed to the cylindrical member 39*c* at the front circumferential surface thereof so that the ring 100 works as a cover or stopper preventing the plunger tip 39*a* from being removed from the cylindrical member 39*c*. With the cover ring 100, the coil spring 99 biases the plunger tip 39*a* against the plunger head 39*b* so that the plunger tip 39*a* is forced to abut axially against the fixed cover ring 100.

A pair of oppositely arranged stopping hydraulic cylinders 103 with respective stopping plungers 104 extending transversely toward the injection plunger tip 39*a* are provided. The stopping plungers 104 have at their heads, slide blocks 102 with concave end surfaces engageable with the cover ring 100. The cover ring 100 is flush with the slide blocks 102 at the inner and outer surfaces thereof and has a diameter smaller than that of the enlarge intermediate tip portion 98 so that an annular groove or recess 101 around the periphery of the plunger tip 39*a* is formed between the enlarged intermediate tip portion 98 and the cylindrical member 39*c*, which groove can receive the slide blocks 102 therein.

The stopping hydraulic cylinders 103 are operated to have the stopping plungers 104 advanced with the slide blocks 102 when the injection process is completed, so that the slide blocks 102 are engaged with the plunger tip 39*a* at the annular groove 101 thereof to thereby prevent the plunger tip 39*a* from being retracted when the block head 42 of the squeezing plunger 12*a* is forced to advance to apply a maximum value of a predetermined oscillating squeeze pressure to the melt 13. When the above engagement is effected between the stopping plunger 104 and the injection plunger 39 at the slide blocks 102 and the plunger tip groove 101, it is not necessary for the operation of the injecting hydraulic cylinder 38 to be stopped temporarily.

With the above machine, it is preferable to determine a desired oscillating squeeze pressure locus to be copied according to the control method of the present invention by an actual squeeze pressure applied to the melt in the mold cavity 40 so as to have a desired mean value to compensate for the melt shrinkage.

By the way, iris important to note that there is at the maximum a certain axial gap or play G between the enlarged intermediate tip portion 98 and the slide blocks 102, the inner surface of which is aligned or flush with that of the cover ring 100, provided in the annular groove 101, when the slide blocks 102 are engaged with the plunger tip 39*a*, and thus the plunger tip 39*a* is allowed to move rearwardly against the coil spring 99, until it abuts against the slide blocks 102, that is, by the gap G at the maximum, in a case where the plunger tip 39*a* is forced rearwardly by the melt 13, while the injection plunger 39 is subjected to the predetermined hydraulic pressure after the injection process. This is advantageous in a case where a metered amount of the melt to be injected into the mold space hole consisting of the chamber 94, the gate 96 and the cavity 40 is varied within a relatively large range in repeated injection cycles. This is because the plunger tip 39*a*, otherwise, would be retracted by a larger amount of a metered melt, if injected, to obstruct the slide blocks 102 from being engaged with the plunger tip, when the stopping hydraulic cylinders 103 are operated to stop the injection plunger movement upon completion of the injection.

Further, it should be noted that if there were a relatively large volume of a chamber D defined as shown in FIG. 11 between an injection plunger tip and a gate open to a mold cavity, a part of the melt in the cavity is allowed to flow out into the chamber through the gate when a squeezing plunger is advanced into the melt in the cavity under a predetermined hydraulic-pressure, and in such case an oscillating squeeze pressure applied to the melt according to the control method of the present invention after completion of the injection would be likely to become unstable at an initial stage where a part of the melt in the gate and chamber has not yet been solidified with the result that a desired crystallization of the melt in the cavity would not be effected. This unstable pressure problem would be eliminated to some extent if a squeezing hydraulic cylinder had an increased capacity or performance allowing the squeezing plunger to move with an oscillating stroke having an increased amplitude enough to compensate for the melt part flowing into the mold cavity and flowing therefrom. This solution, however, would lead to the squeezing hydraulic cylinder being considerably expensive.

In light of the above problems, the apparatus of FIG. 20 is advantageous thanks to a re-metering means comprising the supplemental bisket member 106 in association with the chamber 94 and the plunger tip 39*a* as follows. When the melt 13 is injected into the mold hollow space, an excess part of the melt 13 remains in the space S defined between the stepped top surface of the supplemental bisket member 106 and the stepped bottom surface of the chamber 94. A configuration of the space S as shown in FIG. 20 enables most of the excess melt part to remain in the outer enlarged space portion. This means that a substantially constant amount of a melt, that is, a re-metered melt is ensured to be filled in a combination of the gate 41 and the mold cavity without any substantial part of the melt in the combined space escaping into the space S while the squeezing pressure process continues. Further, the melt in the combined space is ensured to flow into only the central hole of the supplemental bisket member 106, when the plunger tip 39*a* is retracted in accordance with an advance stroke of the squeezing plunger 12*a* with the head 42 for the reason that the supplemental bisket member 106 is adhered to the melt part flown in the space S and it becomes stationary while the plunger tip 39*a* is movable. This means that the oscillating squeeze pressure applied to the melt is subjected to only the front constricted tip portion 96 at a small end surface thereof, and thus a force of the melt exerted on the plunger tip 39*a* is considerably reduced in comparison with that in the machine of FIG. 11, where the large end surface, that is, entire end surface of the injection plunger head is subjected to the melt pressure. Therefore, with the apparatus of FIG. 20, the plunger tip 39*a* is controlled to move with an oscillating stroke having a considerably reduced amplitude in response to the oscillating squeeze pressure applied to the melt at the initial stage of the squeezing pressure process. Of course, the plunger tip 39*a* is not allowed to retract further beyond the slide blocks 102 of the stopper means. As a result, the oscillating squeeze pressure becomes considerably stable even at the initial stage of the squeezing pressure process according to the present invention, where the melt part flown in the space S has not yet been solidified.

The maximum axial gap or play G may be designed so that there is an axial gap of several millimeters to 1 cm between the slide blocks 102 and the enlarged intermediate tip portion 96 provided, when an average amount of the metered melt is injected. If a variation of an axial position of the plunger tip 39*a* when the injection is completed is in the range of 2 to 3 mm or less, the supplemental bisket member 106 is no longer required. The supplemental bisket member 106, however, if needed, must be mounted on the plunger tip 39*a* in each casting cycle. The bisket member 106 is removed together with a real bisket produced in the space S when a cast article is removed from the mold. The removed supplemental bisket member is recycled for a further casting cycle.

Figure 22:
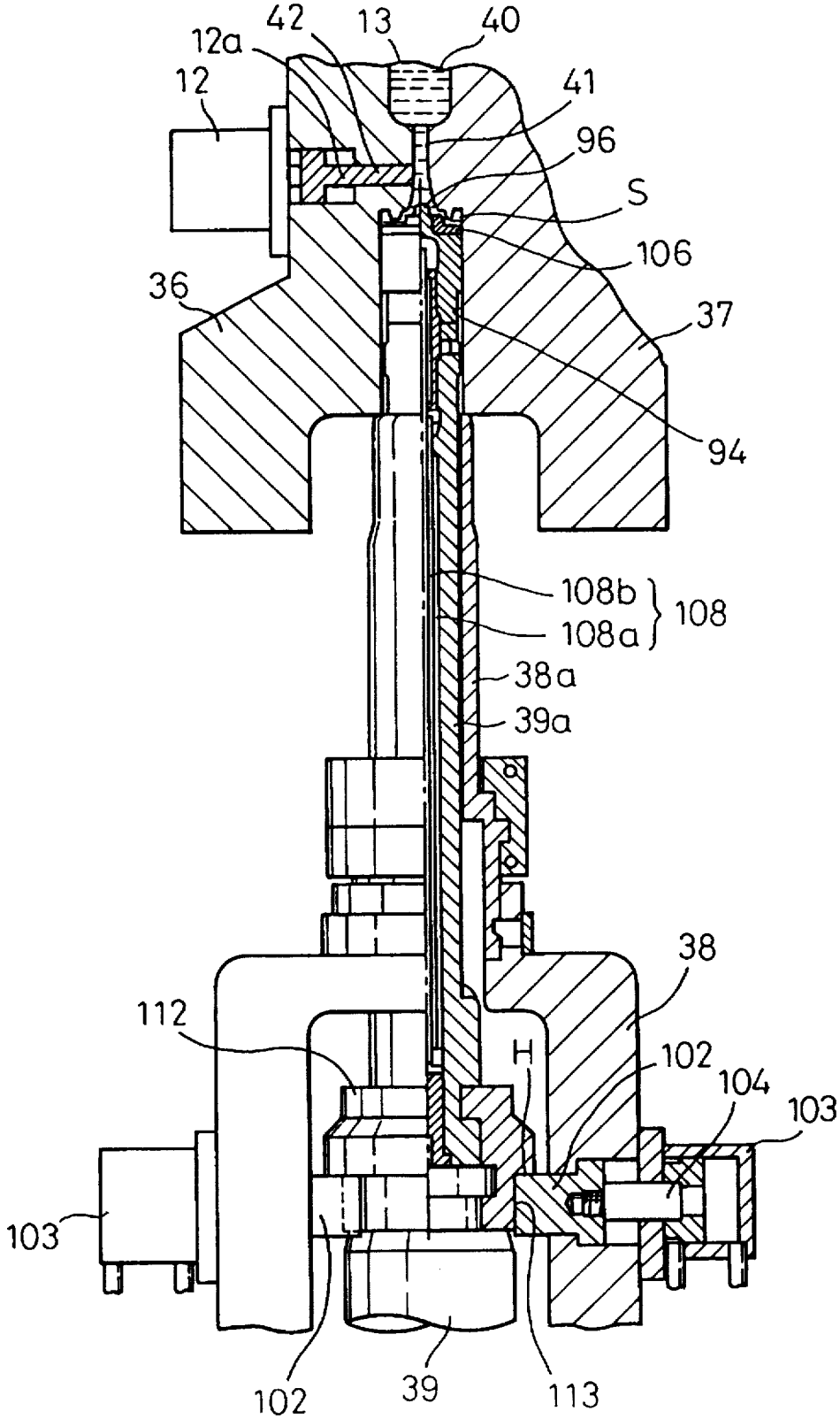
FIG. 22 is a sectional view showing a system corresponding to that of FIG. 20 in another apparatus of the present invention.

FIG. 22 shows another embodiment of a pressure-casting machine provided with a stopper means for an injection plunger of a tilting type injecting hydraulic cylinder, corresponding to that of FIGS. 20 and 21. The machine of FIG. 22 is substantially different from that of FIGS. 20 and 21 in only the stopper means. The stopper means is of a simple construction, and comprises a cylindrical coupling member 112 detachably fixed to an elongated plunger tip 39*a* slidably disposed in a sleeve 38*a* and a pair of a stopping hydraulic cylinders 103 with respective stopping plungers 104 having slide blocks 102. The coupling member 112 is located at a lower end of the plunger tip 39*a* integrated with the head of an injection plunger 39, and has a circumferential groove or recess 113 formed at its peripheral surface. The groove 113 is contoured to have a circumferential shoulder H formed at its upper edge, while it is axially open at the lower end of the coupling member 112. In this connection, the slide blocks 102 can prevent the injection plunger 39 from retracting, when the slide blocks are engaged with the groove 113, at the shoulder H working as a stopper for the plunger tip 39*a*, while it allows the injection plunger 39 to more upwardly so long as the plunger tip 39*a* does not reach a gate 41.

With the machine of FIG. 22, there is no axial gap or play corresponding to that G in FIG. 20, and thus the machine cannot be used to cast a melt injected with a relatively large variation in metered amount, whereas the other machine of FIG. 20 can be used for a melt injected with such a large variation. However, the machine of FIG. 22 is advantageous in that its stopper means is less expensive than that of the other machine and it can be used for an accurately measured melt, that is, a melt injected with a relatively small variation, with the result that a stable oscillating pressure applied to the melt is ensured during an initial stage of the squeezing pressure process according to the present invention.

Both the machines of FIGS. 20 and 22, preferably, are provided with cooling means 108 for cooling the melt part in the space S. The cooling means 108 comprises a fluid passage 108*a* formed in the plunger 39 with the tip 39*a* and a conduit 108*b* for feeding a cooling fluid medium. The cooling means 108 is advantageous in that it causes the excess melt part not to disturb the oscillating squeeze pressure. This is because the melt part is rapidly solidified by cooling so that most of the melt part is not forced to return to the gate and cavity 41, 40, during the initial stage of the squeezing pressure process, when the squeezing pressure 12*a* with the block head 42 is retracted to exert a minimum value of the oscillating squeeze pressure on the melt. This results in an oscillating stroke of the squeezing plunger having a decreased stroke amplitude for exerting the oscillating squeeze pressure with the predetermined amplitude against the melt in comparison with a case of no cooling means.

The oscillating squeeze pressure according to the present invention may be applied more effectively to the melt in the mold cavity with such a squeezing plunger as that exposed at the head thereof to the mold cavity as shown in FIG. 1, 2, 4, 5 or 11, rather than that exposed at the head thereof to the gate as shown in FIG. 20 or 21. This is because, a melt passage between the gate and the cavity is likely to be closed rapidly by solidification of a melt part in the passage during the initial stage of the squeezing pressure process or squeeze pressure applying step. The head of the squeezing plunger should be as large as possible in cross-sectional area, if such a design is allowed.

We claim:

1. A pressure-casting method comprising the steps of feeding a molten metal or melt to be cast into a cavity defined in a casting mold and applying an oscillating squeeze or holding pressure to the melt in the mold cavity by a squeezing plunger of a hydraulic cylinder being moved with a stroke oscillated to have a mean or maximum value varying to compensate for shrinkage of the melt while the melt is being solidified, characterized by controlling the hydraulic cylinder with the squeezing plunger so that a pressure converted from an actual oscillating squeeze pressure applied to the melt to have a mean value of zero copies a predetermined alternately positive and negative impulsive pressure pattern or locus representing a pressure oscillated to have a mean value of zero with a predetermined frequency defined as the number of oscillation cycles per second and a predetermined amplitude defined as the value which is a difference between a maximum value and a minimum value in an oscillation cycle or two times a difference between the maximum value and the zero mean value, versus an elapse of time.

2. A pressure-casting method according to claim 1, wherein the predetermined amplitude and frequency of the impulsive pressure pattern are functions of time.

3. A pressure-casting method according to claim 1, wherein the predetermined amplitude and frequency are constant while the melt is solidified.

4. A pressure-casting method according to claim 2 or 3, wherein the hydraulic cylinder with the squeezing plunger is feedback-controlled with the actual squeeze pressures and a predetermined squeeze pressure locus representing an oscillating squeeze pressure oscillated in accordance with, said predetermined impulsive pressure pattern versus an elapse of time, provided that the oscillating squeeze pressure has a mean value or a maximum value corresponding to a desired squeeze pressure exerted with the plunger stroke for compensating for the melt shrinkage while the melt is being solidified.

5. A pressure-casting method according to claim 4, wherein the squeeze pressure applying step comprises substeps of applying a non-oscillating pressure increasing up to a predetermined value to the melt by increasing the plunger stroke and then carrying out the feedback-controlling for the oscillating squeeze pressure with said predetermined value as an initial mean or maximum value thereof.

6. A pressure-casting method according to claim 2 or 3, wherein the hydraulic cylinder with the squeezing plunger is feedback-controlled with the actual squeeze pressures, said predetermined impulsive pressure pattern and a predetermined plunger stroke locus representing a non-oscillating stroke varying to compensate for the melt shrinkage versus an elapse of time.

7. A pressure-casting method according to claim 6, wherein the squeeze pressure applying step comprises substeps of applying a non-oscillating pressure increasing up to a predetermined value to the melt by increasing the plunger stroke and then carrying out the feedback-controlling for the oscillating squeeze pressure with said predetermined value as an initial mean or maximum value thereof.

8. A pressure-casting method according to claim 5, wherein the feedback-control comprises the steps of: measuring, at sampling time points with a given time interval between neighboring time points, actual squeeze pressures by a pressure sensor mounted in the casting mold or provided in association with the hydraulic cylinder; calculating a deviation of a pressure value obtained from said predetermined oscillating squeeze pressure locus at the present sampling time point from an actual squeeze pressure measured at the present sampling time point; applying an appropriate gain to the calculated pressure deviation to convert the same into a control signal; and controlling a hydraulic pressure of the hydraulic cylinder in accordance with the control signal.

9. A pressure-casting method according to claim 7, wherein the feedback-control comprises the steps of: measuring, at sampling time points with a shorter given time interval between neighboring time points, actual squeeze pressures by a pressure sensor mounted in the casting mold or provided in association with the hydraulic cylinder, and also actual plunger strokes by a stroke sensor mounted in the hydraulic cylinder; calculating a first deviation of an impulsive pressure value obtained from said predetermined impulsive pressure pattern at the present sampling time point from a difference between the actual squeeze pressure measure at the present sampling time point and an assumed mean value of the actual oscillating squeeze pressure at the present sampling time point, calculated with the pressure values measured during a longer given time interval up to the present sampling time point in accordance with a first given formula, and also calculating a second deviation of a stroke value obtained from said predetermined non-oscillating stroke locus at the present sampling time point from an assumed mean value of the actual oscillating stroke at the present sampling time point, calculated with the stroke values measured during the longer given time interval up to the present sampling time point in accordance with a second given formula; applying appropriate gains to the first and second deviations to convert the same into first and second control signals, respectively; producing a third control signal by adding the first control signal to the second control signal; and controlling a hydraulic pressure of the hydraulic cylinder in accordance with the third control signal.

10. A pressure-casting method according to claim 9, wherein said first given formula is represented by an arithmetic mean of the pressure values measured during the longer given time interval up to the present sampling time point, and said second given formula is represented by an arithmetic mean of the stroke values measured during the longer given time interval up to the present sampling time point, said longer given time interval being equivalent to at one or more cyclic periods of time.

11. A pressure-casting method according to claim 9, wherein said first given formula is represented by an arithmetic mean of the pressure values measured during the longer given time interval up to the present sampling time point, and said second given formula is represented by a sum of an arithmetic mean of the stroke values measured during the longer given time interval up to the present sampling time point and a half of a difference between the two stroke values measured at the present sampling time point and a past sampling time point prior to the present sampling time point by the longer given time interval, said longer given time interval being equivalent to one or more cyclic periods of time.

12. A pressure-casting method according to any one of claims 1 to 3, wherein the oscillating squeeze pressure has a mean value of not less than 200 $kg/cm^2$ with an amplitude of not less than 20 $kg/cm^2$ or ±10 $kg/cm^2$ and a frequency of 2 to 500 Hz.

13. A pressure-casting method according to claim 5 wherein the oscillating squeeze pressure has the initial mean value of not less than 400 $kg/cm^2$ with an amplitude of 40 to 1000 $kg/cm^2$ or ±20 to 500 $kg/cm^2$ and a frequency of 5 to 200 Hz.

14. A pressure-casting method according to claim 7, wherein the oscillating squeeze pressure has the initial mean value of not less than 400 $kg/cm^2$ with an amplitude of 40 to 1000 $kg/cm^2$ or 20 to 500 $kg/cm^2$ and a frequency of 5 to 200 Hz.

15. A pressure-casting method according to claim 1, wherein the method is carried out with the casting mold composed of a stationary male mold half and a female mold half to be slidably fitted therewith movable in the direction of the plunger stroke with the squeezing plunger being connected to the movable female mold half.

16. A pressure-casting method according to claim 1, wherein the method is carried out with the casting mold composed of a block part slidably movable relative to the other part thereinto in the direction of the plunger stroke, the movable mold part defining a portion of the mold cavity and being connected to the squeezing plunger.

17. A pressure-casting method according to claim 16, wherein the casting mold has an outlet for a cast product and the cavity contoured to allow the cast product to be discharged through the outlet in the direction of the plunger stroke, the movable block part of the mold being slidably fitted with the outlet.

18. A pressure-casting method according to claim 1, wherein the method is carried out with the casting mold having a gate formed to communicate with the mold cavity and being provided with a block movable into the gate in the direction of the plunger stroke, the block being formed by the squeezing plunger at a free end thereof.

19. A pressure-casting method according to any one of claims 15 to 18, wherein the melt feeding step is carried out by operating a second hydraulic cylinder to effect a stroke movement of an injection plunger for injecting a predetermined amount of melt in the mold cavity, the squeeze pressure applying step being carried out while the stroke movement of the injection plunger is stopped.

20. A pressure-casting apparatus for producing cast articles from a molten metal or melt, comprising: a casting mold having a hollow space to be filled with the melt including a cavity having a contour of the cast article; means for feeding the melt into the hollow space of the mold; a hydraulic cylinder having a squeezing plunger incorporated with the mold to expose a free end of the plunger to the melt filled in the hollow space; and a hydraulic pressure control unit for feedback-controlling the hydraulic cylinder to have the squeezing plunger effect a stroke movement exerting an oscillating squeeze pressure against the melt in the hollow space while compensating for shrinkage of the melt, a pressure converted from said oscillating squeeze pressure to have a mean value of zero copying a predetermined alternately positive and negative impulsive pressure pattern or locus representing a pressure oscillated to have a mean value of zero and a predetermined amplitude and frequency versus an elapse of time, said control unit including means for detecting information on the actual squeeze pressure for use in the feedback-control.

21. A pressure-casting apparatus according to claim 20, wherein the squeezing plunger is exposed at its free end to a part of the melt filled in the cavity.

22. A pressure-casting apparatus according to claim 20, wherein the hollow space of the mold includes a gate formed to communicate with the cavity, the squeezing plunger being exposed at its free end to a part of the melt filled in the gate.

23. A pressure-casting apparatus according to any one of claims 20 to 22, wherein the hydraulic pressure control unit comprises:

1) valve means for changing a hydraulic pressure of the hydraulic cylinder in response to a valve drive signal to control actual stroke movement of the squeezing plunger;

2) valve drive means for generating said valve drive signal in response to a drive command signal;

3) said pressure information detecting means provided to detect actual squeeze pressures and generating actual pressure signals corresponding to the detected squeeze pressures at sampling time points with a given time interval between neighboring time points;

4) feedback control means including:

4-1) command signal setting means for presetting a desired pressure locus representing an oscillating squeeze pressure having a given mean or maximum value corresponding to a desired squeeze pressure exerted with a plunger stroke to compensate for the melt shrinkage with said predetermined amplitude and frequency versus an elapse of time, and generating a reference pressure signal corresponding to a squeeze pressure derived from the preset pressure locus at each sampling time point; and 4-2) signal processing means comprising: means for detecting a deviation of the reference pressure signal from the actual pressure signal at each sampling time point to generate a pressure deviation signal; and gain setting means for converting the pressure deviation signal by applying a given control gain thereto into said drive command signal for said valve drive means.

24. A pressure-casting apparatus according to any one of claims 20 to 22, wherein the hydraulic pressure control unit comprises:

1) valve means for changing a hydraulic pressure of the hydraulic cylinder in response to a valve drive signal to control actual stroke movement of the squeezing plunger;

2) valve drive means for generating said valve drive signal in response to a drive command signal;

3) said pressure information detecting means provided to detect actual squeeze pressures and generating actual pressure signals corresponding to the detected squeeze pressures at sampling time points with a given shorter time interval between neighboring time points;

4) feedback control means including:

4-1) first command signal setting means for presetting said impulsive pressure pattern and generating a reference impulsive pressure signal corresponding to a squeeze pressure derived from the preset impulsive pressure pattern at each sampling time point;

4-2) second command signal setting means for presetting a desired plunger stroke locus representing a non-oscillating stroke varying to compensate for the melt shrinkage versus an elapse of time and generating a reference stroke signal corresponding to a stroke derived from the preset stroke locus at each sampling time point;

4-3) first signal processing means comprising: a first calculator for generating a differential signal corresponding to a difference between the actual oscillating squeeze pressure at the sampling time point and an assumed mean value thereof, which is calculated with the actual pressure signals generated during a given longer time interval up to the present sampling time point in accordance with a first given formula; first means for detecting a first deviation of the reference impulsive pressure signal at the present sampling time point from the differential signal generated by the first calculator to generate an impulsive pressure deviation signal; and first gain setting means for converting the impulsive pressure deviation signal by applying a first given gain thereto into a first drive command signal element;

4-4) second signal processing means comprising: a second calculator for generating a mean value signal corresponding to an assumed mean value of the actual oscillating stroke at the present sampling time point, which is calculated with the actual stroke signals generated during the given longer time interval up to the present sampling time point in accordance with a second given formula; second means for detecting a second deviation of the reference stroke signal at the present time from the mean value signal generated by the second calculator to generate a stroke deviation signal; and second gain setting means for converting the stroke deviation signal by applying a second given gain thereto into a second drive command signal element; and 4-5) a gain adder for generating said drive command signal for said valve drive means by adding the first drive command signal element to the second signal element.

25. A pressure-casting apparatus according to any one of claims 20 to 22, wherein said pressure information detecting means comprises a thin wall part of the mold provided to form a portion of the cavity surface with a reduced thickness relative to the other wall part, and means for detecting yield of the thin wall part generated by the oscillating squeeze pressure applied to the melt and generating a pressure signal in response to the detected yield.

26. A pressure-casting apparatus according to claim 25 wherein said pressure information detecting means comprises: an oscillating means for enabling a yielding thin local wall to oscillate in response to an oscillation of the melt due to the oscillating squeeze pressure, which includes a wall portion of the mold depressed to form said local wall, as said thin wall part, defining a small portion of the mold cavity and having a circumferential thicker portion and a central thinner portion; a block, having a central stepped hole consisting of an outer enlarged portion and an inner constricted portion with a circumferential projection formed at the inner side of the block, mounted detachably in the depressed mold portion to abut at the circumferential projection against the circumferential thicker portion of the local wall with a certain axial gap between the block and the local wall in the region surrounded by the circumferential projection; a yield measuring plate located in the outer enlarged portion of the block hole; a yield transmitting rod extending through the, inner constricted portion of the block hole and disposed between the central thinner portion of the thin local wall and the yield measuring plate in contact therewith; a supporting member detachably fixed to the block in the outer enlarged portion of the block hole for supporting the yield measuring plate at the outer side thereof; and at least one strain gauge attached to the yield measuring plate at the outer side thereof for detecting a strain thereof.

27. A pressure-casting apparatus according to claim 26, wherein said yield measuring plate is of a disk form, and said supporting member is of a ring form and is adapted to support said yield measuring disk at the periphery thereof, said strain gauge being attached to the yield measuring disk at a center thereof.

28. A pressure-casting apparatus according to claim 26, wherein the yield measuring plate is fixed to the supporting member at its one end to form a cantilever, two strain gauges being attached to the cantilever with the the yield transmitting rod abutting against the cantilever at a point located between the two strain gauges.

29. A pressure-casting apparatus according to claim 25 wherein said pressure information detecting means comprises: an oscillating means for enabling a yielding thin wall member to oscillate in response to an oscillation of the melt due to the oscillating squeeze pressure, which includes a stepped hole formed in the mold to open to the mold cavity having an outer enlarged hole portion and an inner constricted hole portion, and said wall member being tight-fitted in the inner hole portion of the stepped mold hole as said thin wall part to define a small portion of the mold cavity at the inner end surface thereof and having a circumferential thicker wall portion and a central thinner wall portion; a block, having a central stepped hole consisting of an outer enlarged portion and an inner constricted portion, mounted detachably in the outer enlarged portion of the mold hole to abut at the inner constricted portion against the circumferential thicker portion of the wall member with a certain axial gap between the block and the wall member in the region surrounded by the circumferential thicker wall portion; a yield measuring disk located in the outer enlarged portion of the block hole; a yield transmitting rod extending through the inner constricted portion of the block hole and disposed between the central thinner portion of the wall member and the yield measuring disk in contact therewith; a coil spring located in the outer enlarged portion of the block hole and biasing the yield measuring disk against a cover plate detachably fixed to the block to cover the block hole; and a displacement sensor attached to the cover plate at the inside thereof and encircled by the coil spring for detecting a gap between the sensor and the yield measuring disk.

30. A pressure-casting apparatus according to any one of claims 20 to 22, wherein said melt feeding means comprises a second hydraulic cylinder with an injection plunger having at least one recess formed at a cylindrical surface thereof and at least one stopper means for the injection plunger comprising a third hydraulic cylinder with a plunger having a slide block as a stopper movable in the direction perpendicular to the injection plunger, the slide block being adapted to engage with the injection plunger at the recess thereof when the stopper means is operated to stop the injection plunger.

31. A pressure-casting apparatus according to claim 30, wherein the injection plunger has a tip and is provided with a supplemental bisket member of a ring form mounted removably on the plunger tip extending therethrough.

32. A pressure-casting apparatus according to claim 31, wherein there are provided a pair of stopper means arranged symmetrically with respect to the injection plunger, each comprising said third hydraulic cylinder having said piston rod and said slide block, the injection plunger comprising an elongated body having a cylindrical end portion with a spring disposed therein and a separate tip part, which has a constricted slide portion and an enlarged head portion, slidably mounted at the slide portion thereof in the cylindrical end portion and biased by the spring against the body, the enlarged head portion of the tip part and the cylindrical end portion defining said recess therebetween to be engaged with respective slide blocks.

* * * * *

UNITED STATES PATENT AND TRADEMARK OFFICE

CERTIFICATE OF CORRECTION

PATENT NO. : 5,560,419

DATED : October 01, 1996

INVENTOR(S) : Atsushi YOSHIDA et al.

It is certified that error appears in the above-indentified patent and that said Letters Patent is hereby corrected as shown below:

Claim 4, column 24, line 20, "with," should read --with--.

Claim 9, column 25, line 5, "measure" should read --measured--.

Claim 14, column 25, line 58, "20" should read --±20--.

Claim 26, column 28, line 38, "the," should read --the--.

Signed and Sealed this

Tenth Day of December, 1996

*Attest:*

*Attesting Officer*

Bruce Lehman

BRUCE LEHMAN

*Commissioner of Patents and Trademarks*